US012084967B2

(12) United States Patent
Pogrebinsky

(10) Patent No.: US 12,084,967 B2
(45) Date of Patent: Sep. 10, 2024

(54) SYSTEM AND METHOD FOR DOWNLINKING COMBINATORIAL FREQUENCIES ALPHABET

(71) Applicant: Michael Simon Pogrebinsky, Houston, TX (US)

(72) Inventor: Michael Simon Pogrebinsky, Houston, TX (US)

( * ) Notice: Subject to any disclaimer, the term of this patent is extended or adjusted under 35 U.S.C. 154(b) by 0 days.

(21) Appl. No.: 18/153,791

(22) Filed: Jan. 12, 2023

(65) Prior Publication Data

US 2024/0240555 A1 Jul. 18, 2024

(51) Int. Cl.

| | |
|---|---|
| ***E21B 47/20*** | (2012.01) |
| ***E21B 21/01*** | (2006.01) |
| ***E21B 21/08*** | (2006.01) |

(52) U.S. Cl.

CPC ..... *E21B 47/20* (2020.05); *E21B 21/01* (2013.01); *E21B 21/08* (2013.01)

(58) Field of Classification Search

CPC ..... E21B 47/20; E21B 21/08; E21B 21/01
See application file for complete search history.

(56) References Cited

U.S. PATENT DOCUMENTS

| | | | | |
|---|---|---|---|---|
| 4,847,815 | A | 7/1989 | Malone et al. | |
| 4,908,804 | A | 3/1990 | Rorden | |
| 6,219,301 | B1 | 4/2001 | Moriarty | |
| 6,327,524 | B1 | 12/2001 | Chen | |
| 6,714,138 | B1 | 3/2004 | Turner et al. | |
| 7,129,673 | B2 | 10/2006 | Eisenhardt et al. | |
| 8,350,715 | B2 | 1/2013 | Shearer | |
| 10,113,420 | B2 | 10/2018 | Pogrebinsky et al. | |
| 2004/0012500 | A1 | 1/2004 | Hahn | |
| 2004/0202047 | A1* | 10/2004 | Fripp | B06B 1/06 340/854.8 |
| 2006/0114747 | A1 | 6/2006 | Hentati | |
| 2007/0189119 | A1* | 8/2007 | Klotz | E21B 47/18 367/83 |
| 2008/0055110 | A1 | 3/2008 | Hahn | |
| 2010/0039287 | A1 | 2/2010 | Li | |
| 2010/0188253 | A1* | 7/2010 | Shearer | H04L 25/4902 340/853.3 |
| 2015/0345287 | A1* | 12/2015 | White | E21B 47/20 367/83 |
| 2016/0201455 | A1 | 7/2016 | Liu | |
| 2017/0284195 | A1 | 10/2017 | White | |

* cited by examiner

*Primary Examiner* — D. Andrews
*Assistant Examiner* — Ronald R Runyan
(74) *Attorney, Agent, or Firm* — McCarter & English, LLP

(57) ABSTRACT

A method for downlinking communication from a surface location to a bottom hole assembly during drilling operation is provided. The method includes pumping drilling fluid through a fluid line and through a drill string to the bottom hole assembly, and generating pressure wave signals by a modulator disposed against an outside surface of the fluid line at an outside-surface location of the fluid line. The modulator is disposed entirely outside of the fluid line. The method includes detecting and receiving at the bottom hole assembly the pressure wave signals generated by the modulator, and processing and decoding the pressure wave signals with a decoder associated with the bottom hole assembly to identify downlinking command purpose and required action for controlling drilling operations.

26 Claims, 28 Drawing Sheets

391 392

| T | Δf | NUMBER OF COMBINATIONS | |
|---|---|---|---|
| | | 1 LETTER | 2 LETTERS |
| 1 s | 1 Hz | 19 | 361 |
| 2 s | 0.5 Hz | 38 | 1444 |
| 4 s | 0.25 Hz | 76 | 5776 |
| 8 s | 0.125 Hz | 152 | 23104 |
| 16 s | 0.0625 Hz | 304 | 92416 |
| ... | | | |
| Tmax | | | |

393 394

FIG. 16

SYSTEM AND METHOD FOR DOWNLINKING COMBINATORIAL FREQUENCIES ALPHABET

FIELD OF THE INVENTION

The present invention relates to telemetry systems for use in a wellbore during drilling and logging-while-drilling (LWD) operations. More particularly, the present invention relates to a method and system for transmitting downlinking commands from a surface-located modulator of harmonic pressure wave signals to a downhole receiver without a physical component inside of a fluid line for generation of the pressure wave signals.

BACKGROUND

A well is typically drilled using a drill bit attached to the lower end of a drill string. At the bottom end of the drill string is a bottom hole assembly (BHA), which can typically include the drill bit, a downhole motor (optional), sensor(s), a source of power, a signal generator, a rotary steerable system (RSS) (optional), and circuitry. A typical BHA includes sensors that measure the BHA's orientation and position, as well as sensors that measure various properties of the formation, such as resistivity, gamma, sonic destiny, porosity, and the like. Some of the measurements can include azimuthal information. Other information and data that may be transmitted from the BHA to the surface can include, e.g., temperature, pressure, drilling parameters, and the like.

The process of drilling can be controlled by comprehensive communication using various experts and operators, and based on analysis of information obtained from the downhole and surface sensors. The drill string is rotated at a desired rate by a rotary table (or top drive) at the surface, and the operator controls the weight-on-bit and other parameters of the drilling process. Another aspect of drilling relates to the drilling fluid (mud), which is pumped from the surface to the drill string. The mud serves to cool and lubricate the drill bit, and it carries the drill cuttings back to the surface. The density of the mud is controlled to maintain hydrostatic pressure in the borehole at desired levels.

During drilling operations, various instructions are sent to the BHA from the surface in order to change adjustable drilling parameters, change logging parameters, and to change or adjust the communication parameters between the surface and downhole system to improve transfer of data. Such communications are known and referred to herein as a "downlink".

Likewise, an "uplink" (as known in the industry and referred to herein) is a communication from the BHA to the surface. An uplink is a transmission of the data collected by the sensors in the BHA. Such data can be used to confirm that the downlink command was correctly detected.

One of the most common downlinking methods in the industry includes using variation of mud flowrate, drill string rotation speed, and generations of series of negative pressure pulses. During the downlinking process, one or more of these parameters are caused to change in magnitude or time duration and/or in numbers.

A downlink using pressure generally necessitates a bypass valve, manipulation of which causes negative pulses to be transmitted through the drilling fluid and detected by a pressure transducer. Typically, the bypass valve diverts a portion of the high-pressure fluid from the supply line back to the mud pit that is at atmospheric pressure. Such venting action can generate high fluid velocities through the valve, resulting in erosion. Valve failure due to such erosion is a safety hazarded under the high pressured environment. In addition, the data transmission speed for such downlinking process can be extremely slow.

U.S. Pat. No. 8,174,404 discusses use of a pulser for downlinking which is disposed in the drilling fluid supply line without the need of a bypass valve. The disadvantage of this option is that a pulser disposed inside of the supply line significantly obscures the flow area, resulting in the need to use a higher pumping pressure level which, in turn, can cause acceleration of wear and tear of the pumping equipment.

Changing the rotational speed to send a downlink signal is not a common method due to the large rotational inertia of the entire drill string. In addition, the rotational speed changes caused by the drilling process may be improperly interpreted by the system as a downlinking command.

One method in the industry for downlinking communications is manipulation of the drilling flow rate to cause changes in the downhole turbine rotation speeds. This method necessitates that the rotary steerable system (RSS) is equipped with a turbine/turbine alternator. Further, in addition to mud pumps, such process necessitates a hydraulic bypass unit controlled by the service company. However, manipulation of the drilling flow rate for downlinking communications results in slow transmission speeds, e.g., typically about 5-10 minutes of a single downlinking command. The low transmission speed limits the amount of downlinking commands and their varieties, preventing the industry from having more control over acquisition parameters and optimal density of the observation.

U.S. application Ser. No. 17/556,502 discusses a downlinking continuous combinatorial frequencies alphabet method and system for downlinking communication during MWD/LWD operations from a surface location to a downhole location by using a pressure wave modulator which is disposed inside of the fluid supply line pipe. The mud pulse system provides a fast and robust downlinking operation capable of optimizing data acquisition and improves management of the rotary steerable system (RSS). However, said system necessitates insertion into the fluid supply pipe at least a portion of equipment containing a rotational restrictional flap.

As such, there is a need in the industry to generate harmonic pressure waves for downlinking without necessitating inclusion of a restrictor of the drilling flow inside the supply pipe. In particular, there is a need in the industry for a system that is capable of generating pressure wave signals in the drilling fluid without a physical component disposed inside of the fluid line for generating said pressure wave signals.

SUMMARY

The present invention discloses a downlinking continuous combinatorial frequencies alphabet method and system for continuous downlinking communication during logging-while-drilling (LWD) and measurement-while-drilling (MWD) operations from a surface location to a downhole location by using a pressure wave modulator disposed entirely outside of a surface fluid supply line. The pulser itself therefore does not obscure or block the flow area of the fluid supply line pipe, ensuring the desired pumping pressures are maintained. The exemplary mud pulse telemetry system provides a fast and robust, continuous downlinking operation capable of providing optimization of data acquisition and improves management for the rotary steerable system (RSS).

In some embodiments, the periodical signals used by the system are frequencies or orthogonal frequencies. In some embodiments, the combinatorial alphabet frequencies method used by the system can include selection and evaluation of the existing modulator or a selection of a modulator based on the required value of maximum frequency (Fmax) which a modulator is configured to generate.

In accordance with embodiments of the present disclosure, an exemplary method for continuous downlinking communication from a surface location to a bottom hole assembly during drilling operation is provided. The method includes pumping drilling fluid through a surface-located fluid line and through a drill string to the bottom hole assembly. The method includes generating continuous pressure wave signals with a modulator associated with the surface-located fluid line, each signal of the pressure wave signals including at least one letter of a downlinking combinatorial frequencies alphabet. The method includes detecting and receiving at the bottom hole assembly the continuous pressure wave signals generated by the modulator. The method includes processing and decoding the continuous pressure wave signals with a decoder associated with the bottom hole assembly to identify digital signal periodical components, and determine a command type and value, for controlling drilling operations.

The at least one letter of the downlinking combinatorial frequencies alphabet includes one or more orthogonal frequencies. The alphabetic component with a highest frequency $F_{max}$ is determined based on evaluation of the modulator. A selection of the modulator is based on a required value of the highest frequency $F_{max}$. The modulator is coupled to the surface-located fluid line. The modulator is attached (directly and/or indirectly) in a compressed manner to at least a portion of the outer circumference of the pipe at an outside/surface location of the pipe to impart hydraulic and/or vibration signals to the outside surface of the pipe to generate the pressure wave signals within the drilling fluid within the pipe. The entire structure for generating the pressure wave signals is therefore disposed outside of the pipe.

An amount of orthogonal frequencies K in the downlinking combinatorial frequencies alphabet can be determined based on a range of frequencies from a minimum frequency $F_{min}$ to a maximum frequency $F_{max}$, and on a selected equivalent duration T of output of a single alphabet member of the downlinking combinatorial frequencies alphabet by: $K=((F_{max}-F_{min})/\Delta f)+1$, where $\Delta f=1/T$ represents a difference in Hz of adjacent orthogonal frequencies, and $T=1,024*2^n$ ms, where n=0, 1, 2 . . . .

The amount of orthogonal frequencies in the combinatorial frequencies alphabet K* is calculated by $K^*=K-1$. An output signal is a combination of one or two alphabet letters, where a second letter of the two alphabet letters is adjacent to a first letter. If an amount of frequencies components for one letter is greater than an amount of all predefined downlinking commands including general purpose and communication group instructions for managing RSS and optimization prescription, then a downlinking command includes from one letter with a structure as $\{F_{si}\}$, where $F_{si}$ is one of the frequencies components form the range from $F_{min}$ to $F_{max}-\Delta f$, each signal frequency component represents a unique combination of one downlinking command purpose and its value. If the amount of predefined downlinking commands is greater than an amount of the frequencies components of one letter of the combinatorial alphabet, a downlinking signal includes from two letters with a structure as $\{F_{si}, F_{si}\}$, where $F_{si}$, $F_{si}$ are frequencies components, the combination of downlinking command purpose and its value, and the combination $F_{si}$, $F_{si}$ represents one of the downlinking commands.

The method includes adjusting the range of frequencies for attenuation during propagation of the continuous pressure wave signals from the modulator to the bottom hole assembly. An effect of the attenuation is represented by:

$$P = P_0 \exp\left[-4\pi f\left(\frac{D}{d}\right)^2\left(\frac{\mu}{K}\right)\right] \tag{1}$$

where P is a signal strength at a surface transducer, $P_0$ is a signal strength at the modulator, f is a carrier frequency of a measurement-while-logging signal. D is a measured depth between a downhole transducer and the modulator, d is an inside diameter of a drill pipe, μ is a plastic viscosity of the drilling fluid, an K is a bulk modulus of a volume of drilling fluid above the downhole transducer.

Based on an effect of the attenuation on higher frequencies alphabet members, a length of a drilling well is divided by two of more intervals and each interval has a different value of maximum frequency $Fmax_i$, where i is a number of intervals. The modulator continually generates the maximum frequency $F_{max}$ before and after transmitting the continuous pressure wave signals to the bottom hole assembly. A division for the intervals is based on predetermined criteria for a minimum amplitude value for each frequency in order to allow robust recording of the generated continuous pressure wave signals for a pressure transducer. Robust recording necessitates that the amplitude of each frequency at the bottom hole assembly depth is 10-15 time greater than a sensitivity of the pressure transducer.

A choice of the command type and value of a downlinking command is based on a combined evaluation of real-time data from bottom hole assembly sensors, surface gages, drilling parameters, information from an onsite operator, and instruction from a remote center. The method includes encoding the downlinking command and transmitting corresponding one or more alphabet letters to a controller of the modulator to generate a harmonic pressure wave signal. The command type associated with the continuous pressure wave signals is divided into three groups: service commands, RSS commands for managing rotary steering system parameters, and optimization commands for optimization of at least one of acquisition and saving energy resources. If multiple command types are transmitted simultaneously, the method includes prioritizing the service commands as highest priority, the RSS commands as a second highest priority, and the optimization commands as lowest priority.

The method includes detecting a presence of flow of the drilling fluid by a sensor disposed in the bottom hole assembly. The sensor is a flow stat device, and the method includes initiating recording of the continuous pressure wave signals by a pressure transducer after detection of the presence of flow of the drilling fluid by the sensor. A sampling frequency of the sensor is not less than $2*F_{maxi}$, where $F_{maxi}$ is a maximum frequency for an i interval.

The method includes removing a constant zero frequency component, applying band-pass filtering and preforming band selectable Fourier analysis on a sliding base equal to a used duration of the at least one letter of the downlinking combinatorial frequencies alphabet to process the pressure wave signals recorded by the pressure transducer. A processor of the pressure transducer recognizes harmonics, which includes decoding of a downhole signal to determine a command purpose and associated command value. Decoding is based on pattern recognition of a behavior of harmonic components of the continuous pressure wave signals along a timeline after applying Fourier analysis on the sliding base.

The method includes continuously using the maximum frequency $Fmax_i$ to analyze a signal-to-white noise level ratio. A criteria for a robust detection of alphabetic harmonic components of the downlinking signals is established when an amplitude of spectrum of a signal harmonics is higher than three standard deviations of amplitude of white noise ($A\ signal > 3*\sigma_{noise}$). An increase of the signal-to-white noise level ratio is achieved by downlinking duration of the at least one letter each time when uplink communication indicates that an amplitude of spectrum for the maximum frequency $Fmax_i$ is not sufficient. If an amplitude spectrum for the maximum frequency $Fmax_i$ is not sufficient, an increase of the signal-to-noise ratio is achieved by increasing the duration of the downlinking command. If the duration of the downlinking signal reaches a predefined limit, the pressure wave signals generated by the modulator are adjusted. When all options are exhausted, and an energy of white noise is 200 times or more than an energy of signal harmonics, the method comprises lifting a drill bit from the bottom hole assembly.

In accordance with embodiments of the present disclosure, an exemplary system for continuous downlinking communication from a surface location to a bottom hole assembly during drilling operation is provided. The system includes a surface-located fluid line, a pump configured to pump drilling fluid through the surface-located fluid line and through a drill string to the bottom hole assembly, and a modulator coupled to the outer surface of the surface-located supply line. The modulator is configured to generate encoded pressure fluctuations in the drilling fluid flowing through the surface-located fluid line by imparting hydraulic and/or vibration signals to the outer surface of the supply line and without having a component inside of the supply line. The system includes a mud pulse telemetry system associated with the bottom hole assembly including at least one sensor for measuring formation properties. The system includes a downhole pressure sensor configured to detect the encoded pressure fluctuations generated by the modulator in the drilling fluid. The system includes a downhole controller and processor configured to process and decode downlinking commands associated with the encoded pressure fluctuations. The system includes a main controller in communication with the bottom hole assembly configured to execute the decoded downlinking commands to control drilling operations.

The modulator is coupled to the outer surface of the surface-located fluid line with one or more jackets capable of being tightly positioned and secured around at least a portion of the circumference of the outer surface of the fluid line. The electrical motor is disposed outside of the surface-located fluid line, the electrical motor having a power unit in the form of a battery or power source. Driving of the modulator with the electrical motor is regulated by a motor controller. A main onsite computer transmits through a data exchange device a sequence of letters of the downlinking combinatorial frequencies alphabet which represents an encoded downlinking command. The modulator generates a pressure wave fluctuation in accordance with the sequence of letters of the downlinking combinatorial frequencies alphabet. The electric motor the signals generated by the modulator based on feedback control signals to maintain the encoded downlinking command. Control of the electrical motor is performed using hall sensors.

The bottom hole assembly includes at least one sensor capable of identified a presence of drilling fluid flow due to pumping of the drilling fluid by a pump through the surface-located fluid line. Detection of starting of pumping and stopping of pumping of the drilling fluid through the surface-located fluid line triggers a start and end, respectively, of recording of pressure fluctuations by a pressure sensor. The pressure sensor includes a processor, software, circuit boards, and a pressure measuring device. A sensitivity of the pressure measuring device is 0.01 psi or 0.001 psi. The pressure sensor is configured to record, filter, process pressure wave fluctuation, and perform amplitude spectrum analysis using a Fast Fourier Transform.

A controller, processor and software are configured to decode the downlinking command by using pattern recognition of signal frequencies based on Fast Fourier Transform results from calculation on a sliding base. The modulator continuously generates the encoded pressure fluctuations with a harmonic signal with a frequency equal to a maximum frequency $Fmax_i$ before and after downlinking commands. A pressure transducer sensor in the bottom hole assembly is configured to calculate a signal-to-white noise level ratio. The pressure transducer sensor is configured to request through an uplink communication an increase of the signal-to-white noise level ratio if the calculated signal-to-white noise level ratio drops below a predefined threshold level.

An initial signal duration of a single combinatorial alphabet letter T is doubled each time when an uplink request is generated until a new calculated time is less than a predefined $Tmax_1$, where $Tmax_1$ is a maximum duration of time allowed for transmission of one letter, or the signal-to-white noise level ratio is increased. When all options are exhausted and an energy of white noise is 200 times or more than an energy of signal harmonics, the drill bit is lifted from the bottom hole assembly and the single combinatorial alphabet letter T is adjusted. A decoded downlinking command type and value is transmitted via internal wires to the main controller of the bottom hole assembly for an execution. A surface sensor real-time information, downhole real-time data, remote center guidance, and onsite operations are processed on the main onsite computer to produce appropriate downlinking instructions to apply the encoded combinatorial alphabet signal schemes at the bottom hole assembly.

In accordance with embodiments of the present disclosure, an exemplary method for downlinking communication from a surface location to a bottom hole assembly during drilling operation is provided. The method includes pumping drilling fluid through a fluid line and through a drill string to the bottom hole assembly, and generating pressure wave signals by a modulator disposed against an outside surface of the fluid line at an outside-surface location of the fluid line. The modulator is disposed entirely outside of the fluid line. The method includes detecting and receiving at the bottom hole assembly the pressure wave signals generated by the modulator, and processing and decoding the pressure wave signals with a decoder associated with the bottom hole assembly to identify downlinking command purpose and required action for controlling drilling operations.

In some embodiments, the modulator can generate the pressure wave signals by applying forces around an entire circumference of the outside surface of the fluid line (e.g., the jacket(s) of the modulator are disposed entirely around a circumference of the fluid line). In some embodiments, the modulator can generate the pressure wave signals by applying forces around a partial circumference of the outside surface of the fluid line. In such embodiments, the modulator (and/or jacket associated with the modulator) is disposed against the partial circumference of the outside surface of the fluid line.

The pressure wave signals generated by the modulator can be periodic wave pressure signals. The pressure wave signals generated by the modulator can include at least one letter of a downlinking combinatorial frequencies alphabet. The at least one letter of the downlinking combinatorial frequencies alphabet can include one or more orthogonal frequencies. An alphabetic component of the downlinking combinatorial frequencies alphabet with a highest frequency $F_{max}$ can be determined based on evaluation of the modulator, and a selection of the modulator can be based on a required value of the highest frequency $F_{max}$. The alphabetic component of the downlinking combinatorial frequencies alphabet with a minimum frequency can be determined based on evaluation of the modulator, and an initial amplitude of pressure wave signals at a frequency $F_{min}$ is equal to or greater than 10-15 times of a transducer sensitivity for a maximum hole measured depth. In selecting the highest and/or lowest frequency, the system can be configured to avoid pump noise frequencies.

The modulator tightly compresses (or can be tightly compressed to) the outside surface of the fluid line and performs periodic force actions in a direction perpendicular (or substantially perpendicular) to the central longitudinal axis of the fluid line. The modulator includes two jackets tightly compressed against the outside surface of the fluid line due to mutual tightening with fixing bolts, each jacket including a compartment filled with oil. In some embodiments, a single jacket with one or more fixation elements could be used to compress the jacket tightly against the outside surface of the fluid line. As used herein, the term "tight" or "tightly" refers to a positioning of one component adjacent to/against and under pressure against another component. For example, the jacket is positioned against the exterior surface of the fluid line and is compressed against the exterior surface of the fluid line to ensure contact along all or most of the surface area of the jacket against the exterior surface of the fluid line. Such positioning ensures accurate transfer of pressure wave signals from the modulator to the fluid line.

In some embodiments, the method can include operating one or more additional modulators to generate additional pressure wave signals along a central longitudinal axis of the fluid line to increase an amplitude of the pressure wave signals. In such embodiments, the multiple modulators can work in combination to collectively generate the desired pressure wave signals. An amount of orthogonal frequencies K in the downlinking combinatorial frequencies alphabet can be determined based on a range of frequencies from a minimum frequency $F_{min}$ to a maximum frequency $F_{max}$, and on a selected equivalent duration T of output of a single alphabet member of the downlinking combinatorial frequencies alphabet by $K=((F_{max}-F_{min})/\Delta f)+1$, where $\Delta f=1/T$ represents a difference in Hz of adjacent orthogonal frequencies, and $T=1{,}024*2^n$ ms, where n=0, 1, 2 . . . .

The method can include adjusting the range of frequencies for attenuation during propagation of the pressure wave signals from the modulator to the bottom hole assembly. An effect of the attenuation can be represented by Equation 1:

$$P = P_0 \exp\left[-4\pi f\left(\frac{D}{d}\right)^2\left(\frac{\mu}{K}\right)\right] \tag{1}$$

where P is a signal strength at a surface transducer; $P_0$ is a signal strength at the modulator; f is a carrier frequency of a measurement-while-logging signal; D is a measured depth between a downhole transducer and the modulator; d is an inside diameter of the fluid line; μ is a plastic viscosity of the drilling fluid; and K is a bulk modulus of a volume of drilling fluid above the downhole transducer.

Based on an effect of the attenuation on higher frequencies alphabet members, a length of a drilling well is divided by two of more intervals and each interval has a different value of maximum frequency $Fmax_i$, where i is a number of intervals. A division for the intervals is based on predetermined criteria for a minimum amplitude value for each frequency in order to allow robust recording of the generated pressure wave signals for a pressure transducer, and robust recording can necessitate that the amplitude of each frequency at the bottom hole assembly depth is 10-15 time greater than a sensitivity of the pressure transducer.

In some embodiments, a choice of a command type and value of a downlinking command can be based on a combined evaluation of real-time data from bottom hole assembly sensors, surface gages, drilling parameters, information from an onsite operator, and instruction from a remote center, and the method can include encoding the downlinking command and transmitting corresponding one or more alphabet letters to a controller of the modulator to generate a harmonic pressure wave signal. In some embodiments, a command type associated with the pressure wave signals can be divided into three groups: service commands, RSS commands for managing rotary steering system parameters, and optimization commands for optimization of at least one of acquisition and saving energy resources. If multiple command types are transmitted simultaneously, the method can include prioritizing the service commands as highest priority, the RSS commands as a second highest priority, and the optimization commands as lowest priority.

The method can include detecting a presence of flow of the drilling fluid by a sensor disposed in the bottom hole assembly. The sensor is a flow stat device, and the method includes initiating recording of the pressure wave signals by a pressure transducer after detection of the presence of flow of the drilling fluid by the sensor. A sampling frequency of the sensor can be not less than $2*F_{maxi}$, where $F_{maxi}$ is a maximum frequency for an i interval. The method can include removing a constant zero frequency component, applying band-pass filtering, and performing band selectable Fourier analysis on a sliding base equal to a used duration of the at least one letter of the downlinking combinatorial frequencies alphabet to process the pressure wave signals recorded by the pressure transducer. A processor of the pressure transducer recognizes harmonics, which includes decoding of a downhole signal to determine a command purpose and associated command value. Decoding is based on pattern recognition of a behavior of harmonic components of the pressure wave signals along a timeline after applying Fourier analysis on the sliding base.

The method can include using a maximum frequency $F_{maxi}$ to analyze a signal-to-white noise level ratio. A criteria for a robust detection of alphabetic harmonic components of the downlinking signals can be established when an amplitude of spectrum of a signal harmonics is higher than three standard deviations of amplitude of white noise ($\Delta_{signal}>3*\sigma_{noise}$). An increase of the signal-to-white noise level ratio can be achieved by downlinking duration of the at least one letter each time when uplink communication indicates that an amplitude of spectrum for the maximum frequency $F_{maxi}$ is not sufficient. If an amplitude spectrum for the maximum frequency $F_{maxi}$ is not sufficient, an increase of the signal-to-noise ratio can be achieved by increasing the duration of the downlinking command. If the duration of the downlinking signal reaches a predefined limit, and an energy of white noise is 200 times or more than an energy of signal harmonics, the method can include lifting a drill bit from the bottom hole assembly. If all options are exhausted, the method can include to stop pumping.

In accordance with embodiments of the present disclosure, an exemplary system for downlinking communication from a surface location to a bottom hole assembly during drilling operation is provided. The system includes a surface-located fluid line, and a pump configured to pump drilling fluid through the surface-located fluid line and through a drill string to the bottom hole assembly. The system includes a modulator disposed against an outside surface of the surface-located fluid line and capable of generating pressure wave signals in the drilling fluid by applying a harmonical force to the outside surface of the surface-located fluid line in a direction perpendicular to a central longitudinal axis of the surface-located fluid line. The system includes a mud pulse telemetry system associated with the bottom hole assembly including at least one sensor for measuring formation properties, and a downhole pressure sensor configured to detect encoded pressure fluctuations generated by the modulator in the drilling fluid. The system includes a downhole controller and processor configured to process and decode downlinking commands associated with the encoded pressure fluctuations, and a main controller in communication with the bottom hole assembly configured to execute the decoded downlinking commands to control drilling operations.

In some embodiments, the modulator can include two jackets fit tightly against the outside surface of the surface-located fluid line and the two jackets can be tightened to each other with fixing bolts. In some embodiments, a single jacket with fixation elements can be used to secure at least partially around the circumference of the fluid line. An inner surface of the jackets can be a thin steel plate which, with increasing oil pressure in the jackets, fits snugly against the outside surface of the surface-located fluid line. An outer part of the jackets can be a thick steel plate capable of withstanding with a standard margin a maximum oil pressure achieved during operation of modulator. Each jacket can be mechanically and hydraulically connected to a stepped hydraulic cylinder with a hydraulic piston which generates harmonic pressure in oil inside of the jackets. A stepped hydraulic cylinder can be connected by a pressure hose to a hydraulic cylinder of lower pressure with a piston performing reciprocating movements due to a cam mechanism. The cam mechanism can include a flywheel of a profile that ensures movement of the piston in a lower pressure chamber according to a harmonic law. The cam mechanism can be driven by an electric motor which is disposed outside of the surface-located fluid line. The electrical motor includes a power unit in a form of a battery or power source. Driving of the modulator with the electrical motor is regulated by a motor controller.

A main onsite computer can transmit through a data exchange device a sequence of letters of a downlinking combinatorial frequencies alphabet which represents an encoded downlinking command. The modulator can generate a pressure wave fluctuation in accordance with the sequence of letters of the downlinking combinatorial frequencies alphabet. The bottom hole assembly can include at least one sensor capable of identifying a presence of drilling fluid flow due to pumping of the drilling fluid by a pump through the surface-located fluid line. Detection of starting of pumping and stopping of pumping of the drilling fluid through the surface-located fluid line can trigger a start and end, respectively, of recording of pressure fluctuations by a pressure sensor. The pressure sensor includes a processor, software, circuit boards, and a pressure measuring device. A sensitivity of the pressure measuring device can be about 0.01 psi or 0.001 psi. The pressure sensor can be configured to record, filter, process pressure wave fluctuation, and perform amplitude spectrum analysis using a Fast Fourier Transform. A controller, processor and software can be configured to decode the downlinking command by using pattern recognition of signal frequencies based on Fast Fourier Transform results from calculation on a sliding base.

The modulator can generate the encoded pressure fluctuations with a harmonic signal with a frequency equal to a maximum frequency $F_{maxi}$ before and after downlinking commands, and a pressure transducer sensor in the bottom hole assembly is configured to calculate a signal-to-white noise level ratio. The pressure transducer sensor can be configured to request through an uplink communication an increase of the signal-to-white noise level ratio if the calculated signal-to-white noise level ratio drops below a predefined threshold level. An initial signal duration of a single combinatorial alphabet letter T can be doubled each time when an uplink request is generated until a new calculated time is less than a predefined $T_{max1}$, where $T_{max1}$ is a maximum duration of time allowed for transmission of one letter. When all options are exhausted and an energy of white noise is 200 times or more than an energy of signal harmonics, a drill bit can be lifted from the bottom hole assembly and the single combinatorial alphabet letter T can be adjusted by varying T. A decoded downlinking command type and value can be transmitted via internal wires to the main controller of the bottom hole assembly for an execution. A surface sensor real-time information, downhole real-time data, remote center guidance, and onsite operations can be processed on the main onsite computer to produce appropriate downlinking instructions to apply the encoded combinatorial alphabet signal schemes at the bottom hole assembly.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skillful at the art in making and using the method and system for downlinking signal transmission with alphabet frequencies, reference is made to the accompanying figures, wherein:

FIG. 16 is a table showing a number of combinations of orthogonal frequencies from a duration of signal T for words containing one and two letters, if a useful range of frequencies is 2-20 Hz.

DETAILED DESCRIPTION

Figure 1:
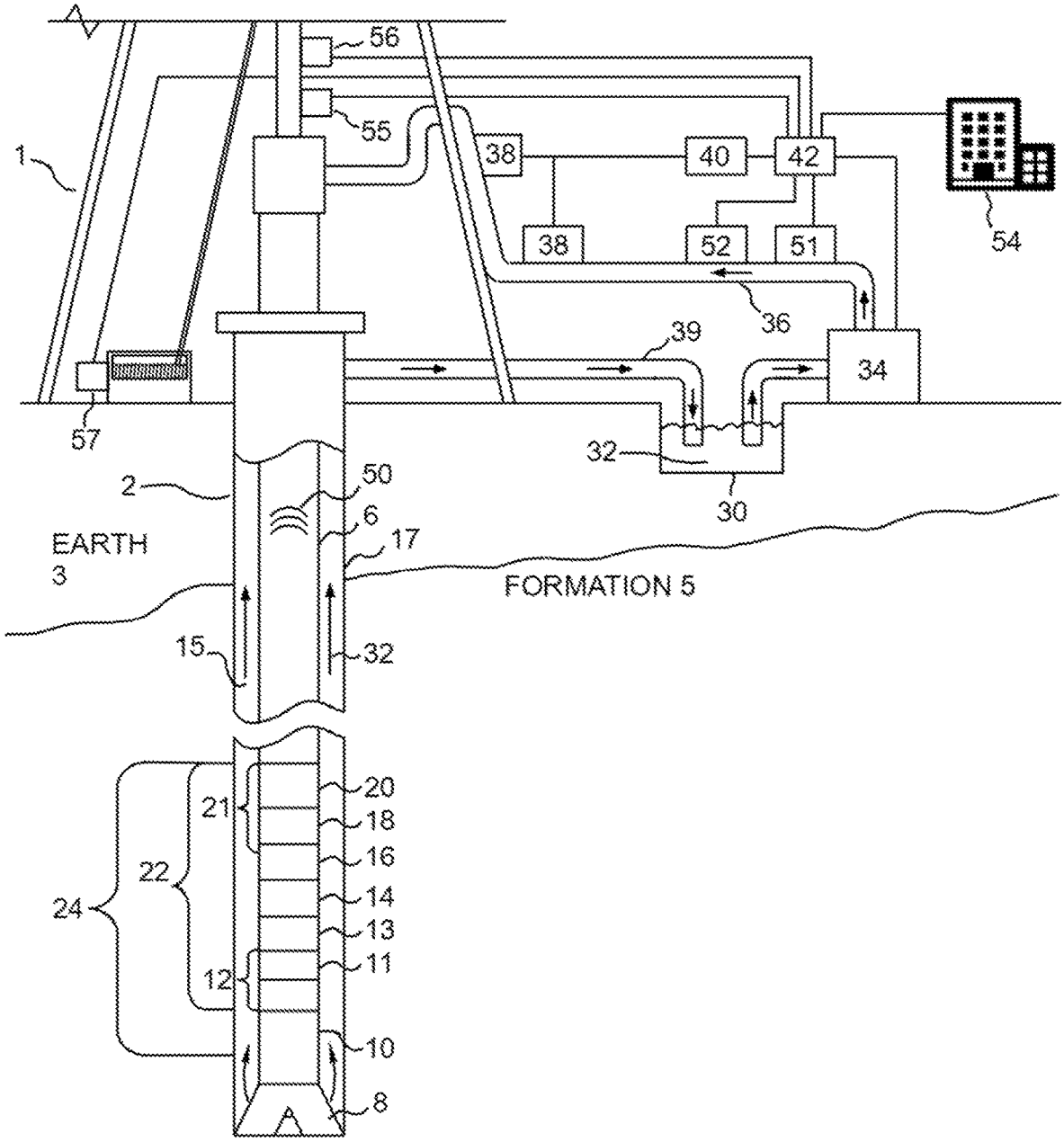
FIG. 1 is a diagrammed view of a drilling rig with an exemplary system for transmitting pressure waves signals to a downhole according to the present disclosure.

FIG. 1 is a diagrammatic view of a drill rig 1 for implementation of an exemplary system for downlinking communication using a surface based generator for harmonical pressure wave signals. The drilling rig 1 can be engaged in drilling operation with simultaneous LWD acquisitions and downlinking which can be used for communication between the surface and the bottom hole assembly (BHA) based on transmission of pressure wave signals with different frequencies. As discussed herein with respect to operation of the exemplary signal downlinking transmission system, LWD operation can include both LWD and measurement while drilling (MWD) operation, as well as additional measurements. During operation, a well borehole 2 is drilled into the ground 3 through formation 5 by using the rotary drilling rig 1.

Drilling operations generally include the circulation of drilling fluid 32 (e.g. drilling mud) by a pump 34 through a mud line 36, into and through a drill string 6 down to the drill bit 8, and back to the surface (e.g., ground level and above) through the annulus 15 between the drill string 6 and the borehole wall 17. The drilling fluid 32 exits the wellbore 2 via a return conduit 39, which routes the drilling fluid 32 back to mud pits 30 through the mud cleaning system (not shown). The modulator 51 generates pressure wave signals in the drilling fluid traveling through the mud line 36 by applying forces to the external surface of the flow line pipe (e.g., the mud line 36). The modulator 51 can apply these pressure wave signals directly to the mud line 36 and/or indirectly (e.g., through an additional structural component connecting the modulator 51 to the external surface of the mud line 36). In some embodiments, the modulator 51 can include one or more brackets or jackets configured to tightly position or compress the modulator against the external surface of the mud line 36. In some embodiments, the brackets or jackets can position the modulator against a portion of the circumference of the mud line 36. In some embodiments, the brackets or jackets can surround the entire circumference of the mudline 36. The transducer 52 measures pressure changes near the modulator 51.

The bottom hole assembly (BHA) 22 at or near distal end 24 of the drill string 6 can include one or more other sensor modules 12. In some embodiments, sensor modules 12 of the BHA can include flow sensor 11, directional sensors, formation evaluation sensors, combinations thereof, or the like. The BHA 22 includes at least one-pressure transducer 13, one or more sources of energy 14 (e.g., batteries or/and generators, and down hole electronics (including controller 16) in communication with the sensors 12 including flow sensor 11, transducer 13 and a pulsar assembly 21. The pressure transducer 13 incorporates the embedded controller that is powerful enough to perform Fast Fourier Transform (FFT) operations in real time, filtering, detecting and decoding downlinking signals.

The pulsar assembly 21 can include a modulator 20, motor control and electronic power board 18. During operation in the uplink mode the pressure fluctuation 50 propagate to the surface through the mudflow in the drill string 6 and are detected at the surface by a transducer(s) 38 which is connected to flow line 36. The analog/digital device 40 transmits a digital form of the pressure signals to a processing 42 (e.g., a computer or some other type of a data processing device). Processing device 42 operates in accordance with software to process and decode the signals received from the analog/digital device 40. The resulting LWD data can be further analyzed and processed to generate a display of various useful information. For example, the system can include a graphical user interface (GUI) capable of displaying data acquired and/or processed by system during the drilling operation. The resulting data also can include information related to a confirmation of the downlink command.

The unit 10 of the BHA 22 in FIG. 1 represents a downhole motor and/or a rotary steerable system (RSS), or their combination. The fast and often communication via the present invention downlinking allows timely adjustment of any combination of RSS controllable parameters. For example, in case of the points the bit of the tool, the system can transmit a downlink signal which can have instructions for a deflection change and/or a new tool face settling.

Selection of a downlinking command to communicate with BHA is a comprehensive process, taking into account the readings of various surface sensors 55, 56, 57 (hook load sensor 56, depth tracking sensor 57, and the like) along with well planning trajectory, 3D geological model, mud log information and others the like data. All the above information can be revived in real time by different experts on site or remotely (54) in order to make a decision for controlling the drilling process and optimize data acquisition. Based on the comprehensive analysis of the above information, the downhole command is selected and then transmitted in real time (or substantially in real time) to the downhole BHA.

Figure 2:
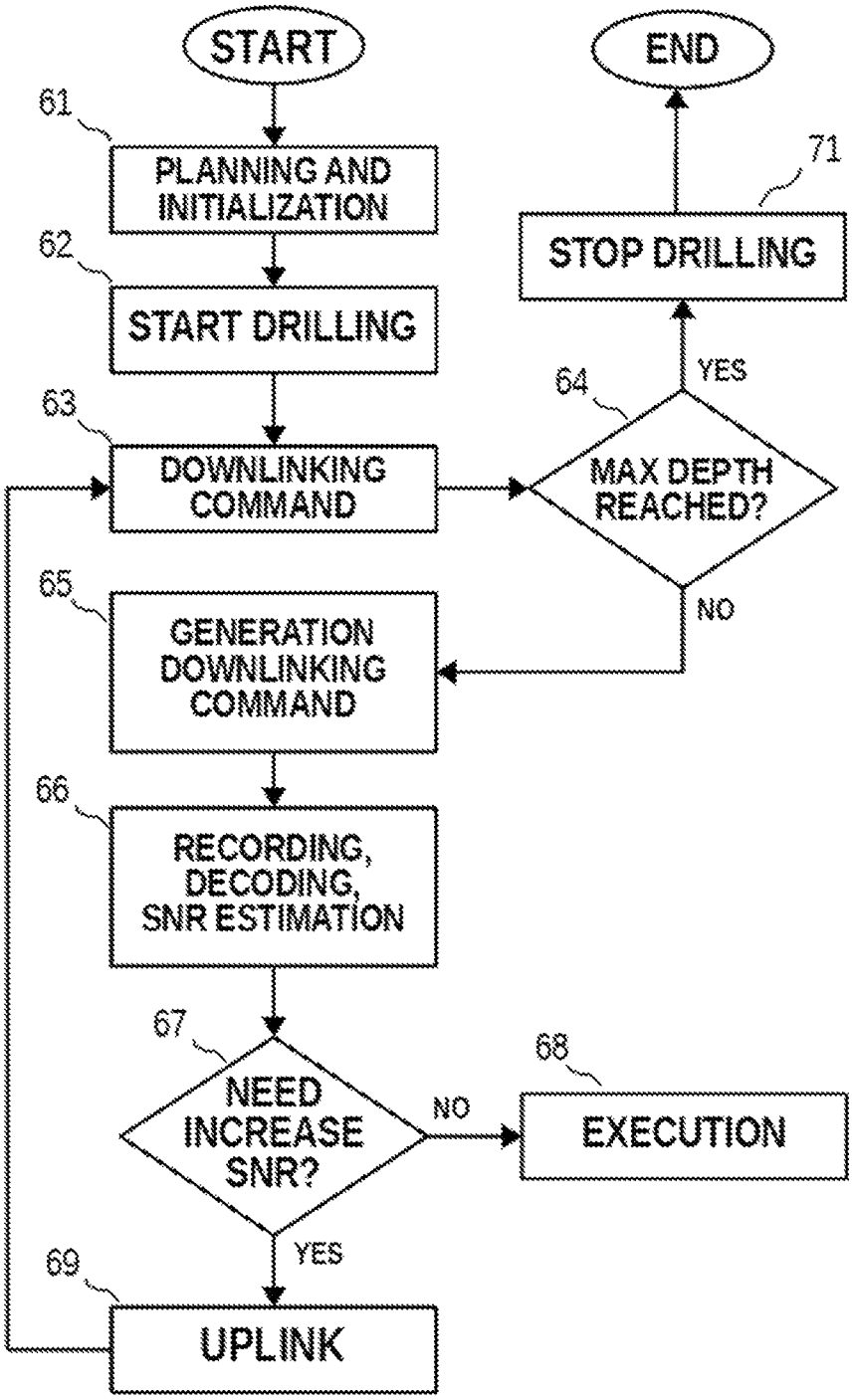
FIG. 2 is a flow chart illustrating a method for downlinking signal transmission with alphabet frequencies according to present disclosure.

FIG. 2 provides an overview of the method of downlinking. Planning stage (step 61) includes evaluation of a modulator, determining a list and amount of commands for downlinking, assessment of pressure wave attenuation, determining a frequencies range and time for downlinking transmission of harmonical signals, estimation of pressure wave amplitude, defining encoding schemas, combinations thereof, or the like. Initialization stage (step 61) includes establishing, and setting parameters for communication between surface sensors, rig site computers, modulator, and remote center, as well as programming BHA components, and assembling BHA components. After the start (step 62) of the drilling process an appropriate downlinking command is selected (step 63); if the target depth of the well is not reached (step 64), the corresponding signal is generated (step 65). When the target depth is reached (step 64), the drilling is stopped (step 71). The downlinking signal propagates through the drill fluid acoustic channel, the parameters of which are determined by pipe diameters and drill fluid properties (density, viscosity). At the next step (step 66), the downlinking signal is recorded, processed, decoded and SNR is calculated. If SNR (step 67) is above the predefined threshold level, the decoded command is executed (step 68); otherwise an alerting information is uplinked (step 69). The method includes options designed to increase the ratio of signal-to-noise. The novel method of downlinking combinatorial frequencies alphabet results in an optimization of acquisition process, adjusting RSS parameters and execution of various service instructions.

Figure 3A:
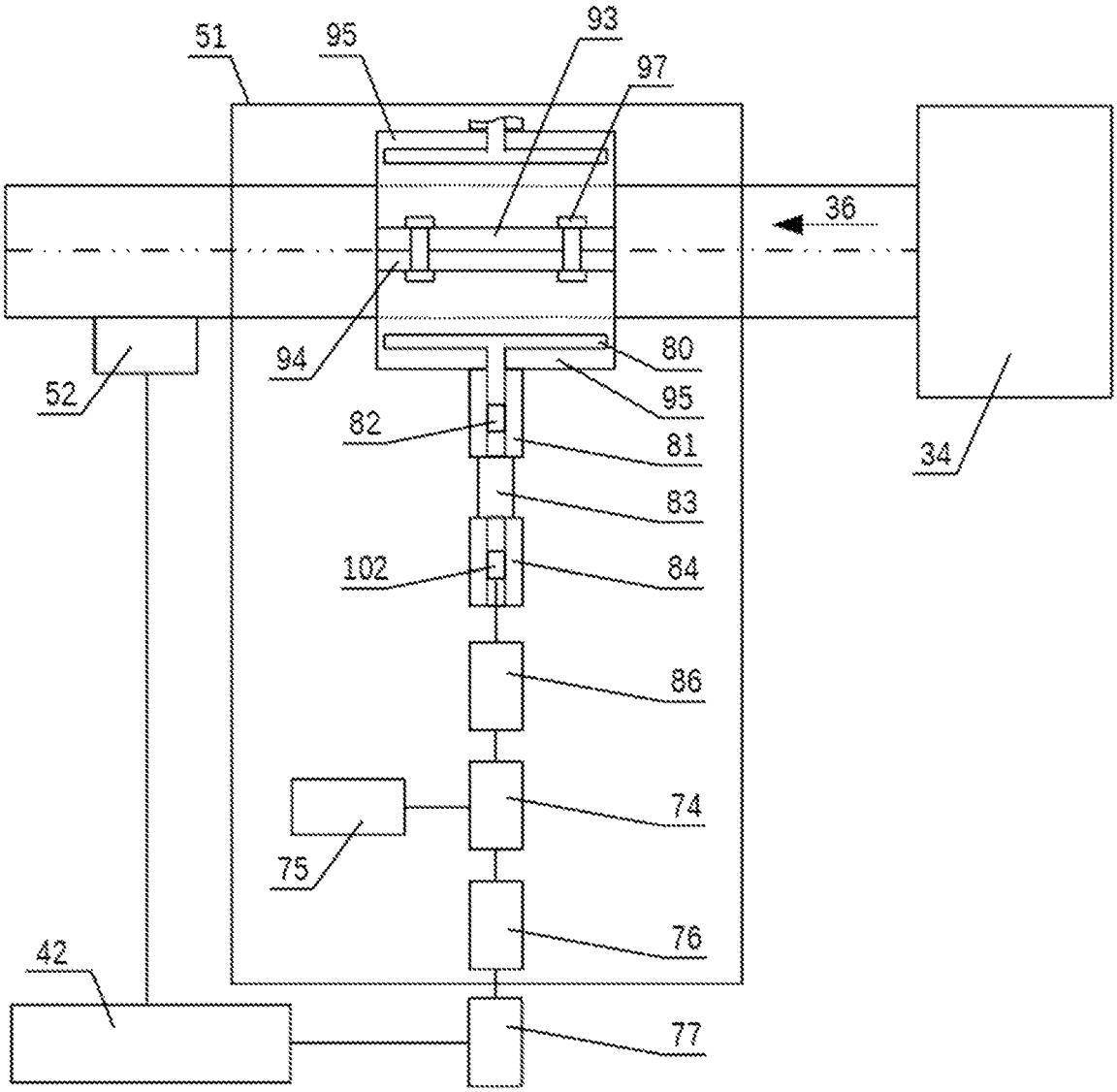
FIG. 3A is a side view of a modulator incorporated into the system for transmitting pressure wave signals to downhole pressure transducer according to the present invention.

FIG. 3A shows of a portion of the drilling rig 1 in FIG. 1 having downlinking system, including the modulator 51 of harmonic signals in accordance with embodiments of the present invention. The mud line 36 defines a pipe with an outside surface defining an outer diameter and having a hollow interior defining an inner diameter through which drilling mud flows. The mud flows in a direction parallel to a central longitudinal axis of the mud line 36. The inner diameter of the mud line 36 therefore defines an area capable of receiving the mud flow. The modulator 51 of harmonic signals is configured for mounting to the outside surface of the mud line 36 to apply pressure onto the external side of the mud line 36 at any time when pump 34 is on or off. Mounting of the modulator 51 can be around the entire circumference of the mud line 36 or can be only around a portion of the circumference of the mud line 36. The modulator 51 includes two jackets 95, 96 with oil-filled space 80. The jackets 95 have flanges 93, 94. The jackets 95 are tightly connected or coupled to each other by tightening the flanges 93 and 94 by fixing bolts 97. The jackets 95 associated with the modulator 51 can thereby be positioned at least partially around the outside surface of the mud line 36 and secured such that the modulator 51 (through the jackets 95) is positioned against the outside surface of the mud line 36.

Each jacket 95 is mechanically and hydraulically connected to the stepped hydraulic cylinder 81 with hydraulic piston 82, which generates harmonic pressure in oil chamber 80. This pressure is transmitted through the thin inner wall of the jacket 95 to the outer surface of the mud line 36, and then from the outer surface of the mud line 36 to the drilling fluid inside the mud line 36. The modulator 51 thereby transfers the harmonic pressure changes through the jackets 95 to the drilling fluid in the mud line 36.

The stepped hydraulic cylinder 81 is connected by pressure hose 83 to hydraulic cylinder of lower pressure 84 with piston 102. The piston 102 performs reciprocating movements due to the cam mechanism 86 with flywheel of a special profile. The cam mechanism 86 is driven by an electric motor 74. The electric motor 74 is powered by a power source or unit 75. The electric motor 74 is controlled by a control unit 76 (e.g., a controller), which is configured to receive instruction signals for generating a particular downlinking command from computing device 42 of the system through communication device 77. Software of computing device 42 takes into account the initial amplitude of pressure waves generating by the modulator 51 by obtaining pressure measurement signals from transducer 52.

Figure 3B:
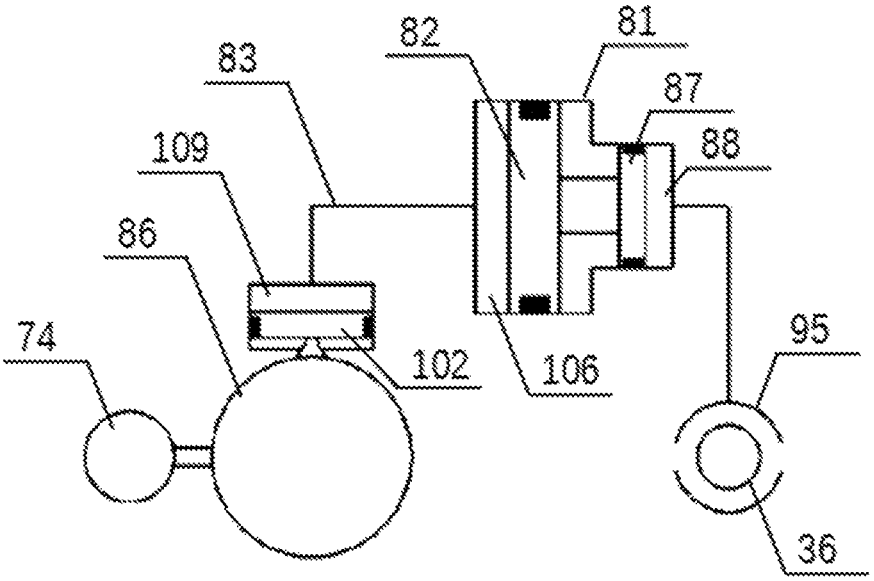
FIG. 3B is a hydraulic diagram of a stepped hydraulic cylinder schematically shown in FIG. 3A by positions 80, 81, 82, 83, 84 and 102.

FIG. 3B is a schematic view of the mechanism designed to deliver high pressure inside the chamber 80 of the jacket 95 mounted on the pipe (e.g., mud line 36). It includes high-pressure chamber 88, high-pressure piston 87 rigidly connected to the big end of low pressure piston 82 that moves inside the chamber 106, connected by the pressure hose 83 to low pressure chamber 109 of piston 102. The electric motor 74 rotates the cam 86 pushing the piston 102 inside low pressure chamber 109.

In order to reach the required working pressure $p_1$ in the chamber 80 of the jacket 95, the volumetric change $dV_1$ of the working oil is determined using Equation 2:

$$dV_1 = \frac{p_1 V_1}{K} \tag{2}$$

where K is a bulk modulus of working oil. The volume $V_0$ of chamber 80 of the jacket 95 is determined using Equation 3:

$$V_0 = S_0 L_0 \tag{3}$$

where $S_0$ is section area and $L_0$ is a length of the chamber 80. The square of the high-pressure piston 87 with diameter $d_1$ is determined using Equation 4:

$$S_1 = \frac{\pi d_1^2}{4} \tag{4}$$

The stroke of a piston 82 is determined using Equation 5:

$$L_1 = \frac{dV_1}{S_1} \tag{5}$$

The square of the big low-pressure piston 82 is determined using Equation 6:

$$S_2 = S_1 \frac{p_1}{p_3} \tag{6}$$

The diameter $d_2$ of the big low-pressure piston 82 is determined using Equation 7:

$$d_2 = \sqrt{\frac{4S_2}{\pi}} \tag{7}$$

The stroke $L_2$ of the piston 82 and stroke $L_1$ of the piston 87 are equal because they are connected. The volume of big low-pressure piston chamber is determined using Equation 8:

$$V_2 = S_2 L_2 \tag{8}$$

and it is equal to the volume $V_3$ of small low-pressure piston chamber 109, which is determined using Equation 9:

$$V_3 = \frac{p_1}{p_3} dV_1 \tag{9}$$

The square of the small low-pressure piston 102 is determined using Equation 10:

$$S_3 = \frac{\pi d_3^2}{4} \tag{10}$$

and its stroke is determined using Equation 11:

$$L_3 = \frac{V_3}{S_3} \tag{11}$$

Additional stroke of the piston 102 due to compressibility of oil is determined using Equation 12:

$$dL_3 = \frac{p_3(S_3 L_3 + S_3 l)}{K S_3} \tag{12}$$

On-peak and average power required to move piston 102 is determined using Equations 13 and 14:

$$N_{max} = 2 p_3 V_3 F \tag{13}$$

$$N_{avg} = p_3 V_3 F \tag{14}$$

Based on the results of numerical simulation (discussed below), the following input parameters for a modulator 51 were chosen as an illustrative example:

maximum pressure in the jacket chamber 80 $p_1$=250 atm;
jacket chamber 80 length $L_1$=0.5 m;
jacket chamber cross-section area $S_1$=300 $mm^2$;
maximum pressure in low-pressure chamber 106 $p_2$=50 atm;
bulk modulus of the oil K=1000 MPa;
length of pressure hose 83 1=0.5 m; and
$F_{max}$=20 Hz.

It should be understood that the values discussed herein are merely used for example purposes and are not limiting to the disclosure. In particular, different values for the modulator 51 can be used to achieve similar operational results. Based on the above formulas, the following derived values were calculated:

volumetric change of the oil in the jacket $dV_1$=0.004 liter ($V_1$=$L_1S_1$=0.150 liter);
diameter of high-pressure piston 82 $d_1$=14 mm;
stroke of piston $L_1$=25 mm;
big end of low-pressure piston 82: $d_2$=31 mm, $L_2$=25 mm, $V_2$=0.019 liter;
diameter of lower pressure piston $d_3$=25 mm, stroke=39 mm, $V_3$=0.019 liter;
additional stoke of low-pressure piston 102 due to compressibility of oil $dL_3$=2.73 mm (or 7%);
on-peak power $N_{max}$=3.88 KW; and
average power $N_{avg}$=1.94 kW.

Figure 4:
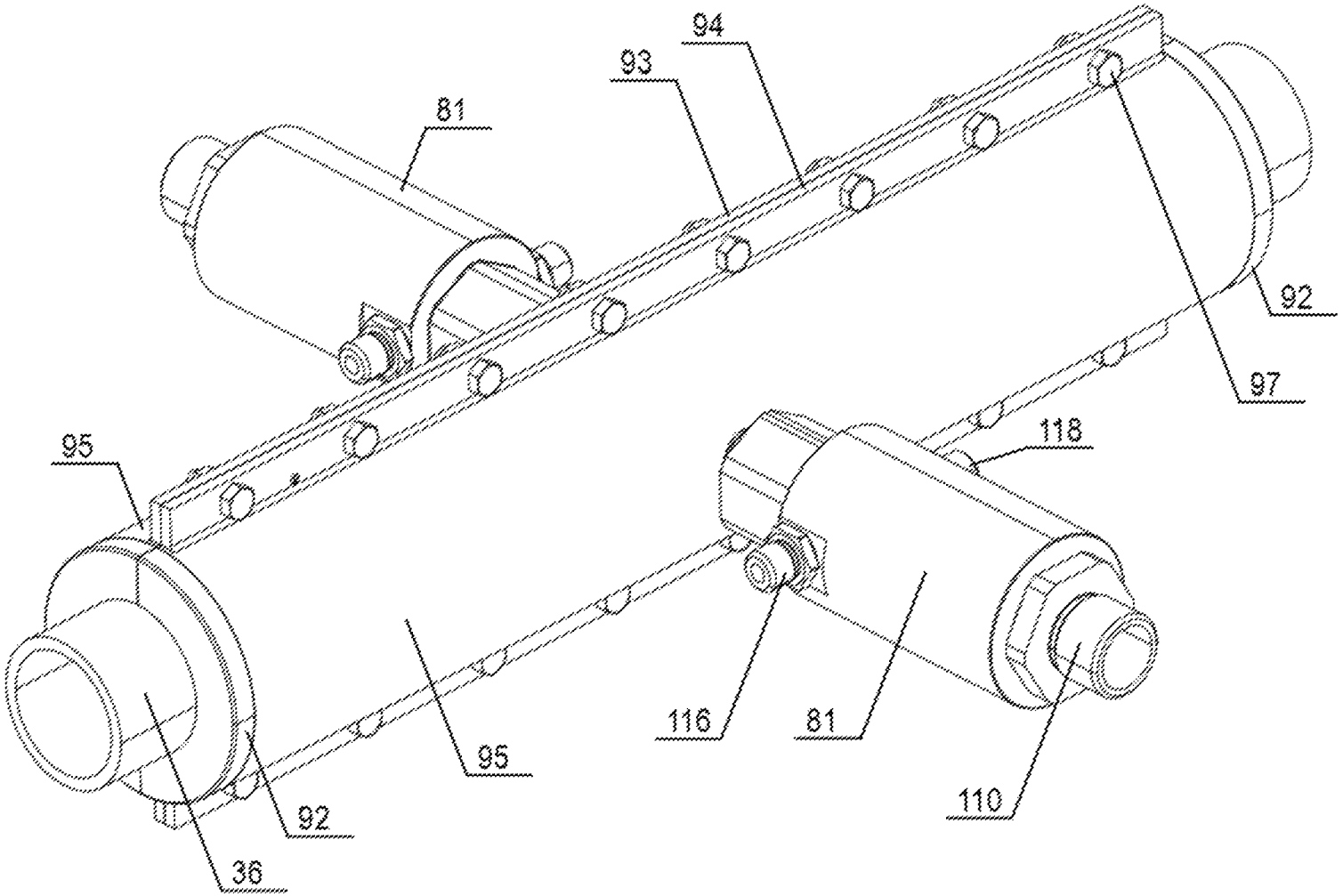
FIG. 4 is a perspective view of a portion of a modulator shown in FIG. 3A.

FIG. 4 shows two halves of the jacket 95 mounted on the mud line 36, pressed against each other (and coupled to each other) by flanges 93, 94 and fastened with fixing bolts 97 to maintain the jackets 95 tightly against the outer surface of the mud line 36. In some embodiments, each jacket 95 can define a substantially semicircular shape such that each jacket 95 half surrounds half of the surface area of the mud line 36. In some embodiments, one or more jackets 95 can surround less than 100% of the surface area of the mud line 36, and additional flanges or brackets can be used to secure the jacket 95 to the outer surface of the mud line 36. In both instances, the jackets 95 are positioned tightly against the outer surface of the mud line 36 to ensure transfer of pressure waves from the modulator 51 to the outer surface of the mud line 36, and from the mud line 36 to the drilling fluid within the mud line 36. Each half of the jacket 95 includes the oil chamber 80 (FIG. 3A) where high pressure exerts a compressive effect on the pipe 36. Two welded side walls 92 form jacket sides. A stepped cylinder mechanism 81 has oil pressure pickup port 116, drain fitting 118, and fitting 110 for connectable to a pressure hose. The jackets 95 can surround the entire circumference of a portion of the mud line 36, or can surround only a portion of the circumference.

The jackets 95 can be dimensioned to extend along a certain length of the outside surface of the mud line 36 as measured in a direction parallel or substantially parallel to the central longitudinal axis of the mud line 36, such as, e.g., 0.1-1 meters inclusive, 0.1-0.9 meters inclusive, 0.1-0.8 meters inclusive, 0.1-0.7 meters inclusive, 0.1-0.6 meters inclusive, 0.1-0.5 meters inclusive, 0.1-0.4 meters inclusive, 0.1-0.3 meters inclusive, 0.1-0.2 meters inclusive, 0.2-1 meters inclusive, 0.3-1 meters inclusive, 0.4-1 meters inclusive, 0.5-1 meters inclusive, 0.6-1 meters inclusive, 0.7-1 meters inclusive, 0.8-1 meters inclusive, 0.9-1 meters inclusive, 0.2-0.9 meters inclusive, 0.4-0.7 meters inclusive, 0.1 meters, 0.2 meters, 0.3 meters, 0.4 meters, 0.5 meters, 0.6 meters, 0.7 meters, 0.8 meters, 0.9 meters, 1 meter, or the like. In some embodiments, two or more jackets 95 can be used adjacently (and optionally coupled to each other) to extend the overall length along which the jackets 95 are positioned. In such embodiments, the jackets 95 can operate in a corresponding or unitary manner to ensure consistent generation of pressure wave signals.

Figure 5:
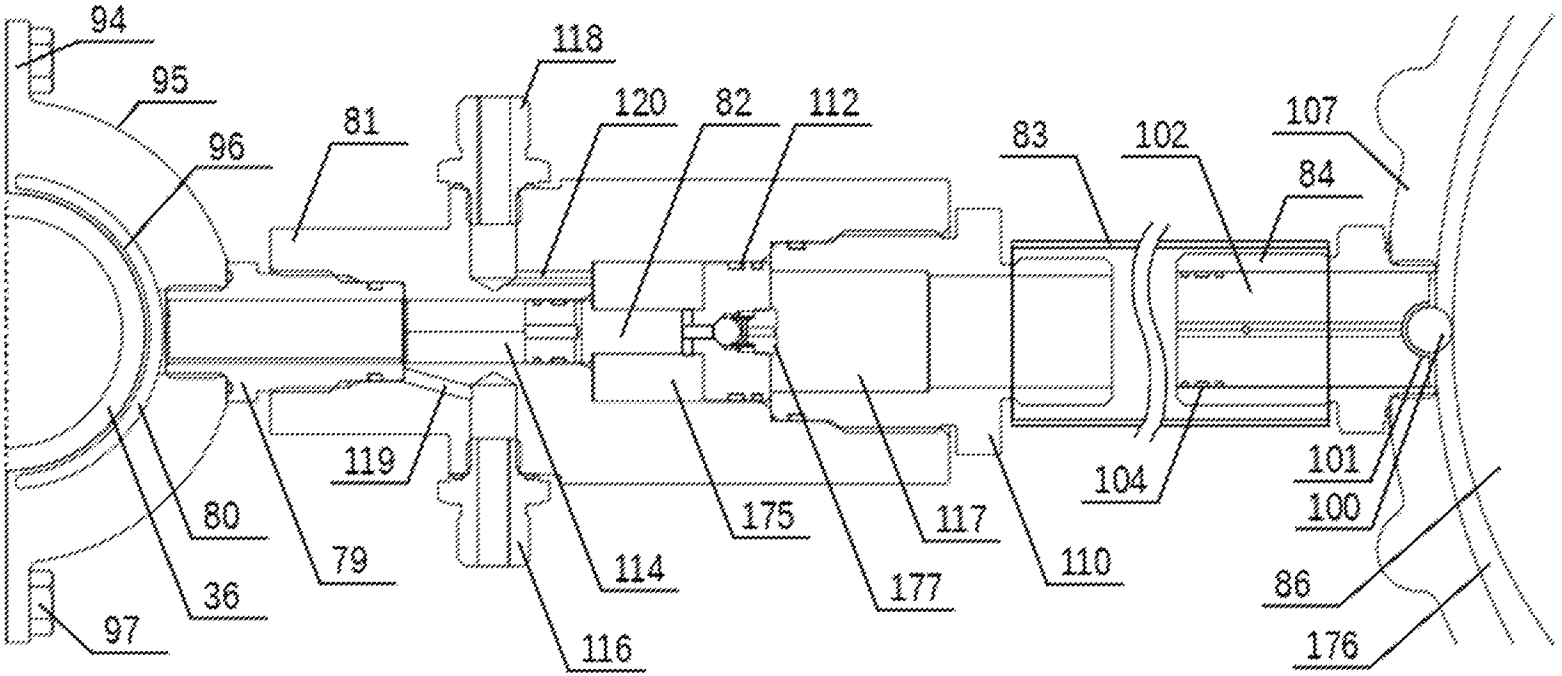
FIG. 5 is a cross-sectional view of a portion of a modulator shown in FIG. 3A.

FIG. 5 depicts a vertical section of the system designed to create harmonic signal in the drilling fluid inside the manifold pipe 36 by pressing on the outer wall of the pipe towards the pipe axis (e.g., substantially perpendicularly to the central longitudinal axis of the mud line 36). The device includes two halves of the jacket 95 tightly wrapped or positioned around and against the manifold pipe 36, a mechanism of stepped hydraulic cylinders 81, a pressure hose 83 and a flywheel 86. The inner side of the jacket 95 is firmly connected to the manifold pipe 36 via flanges 94 and 93 (not shown) and bolts 97; however, alternative means for fixating the jacket 95 to the outside surface of the pipe 36 can be used. Initial volume of oil is filled into the chamber 80 through the back-flow prevention valve 177 which is closed during operation mode of the modulator 51. The pressure changes in the chamber 80 are caused by reciprocating movements of a piston 82 disposed within the mechanism of hydraulic cylinder 81, which is connected to jacket via fitting 79. Each end of the stepped piston 82 is sealed by the rings 112. Pressure amplification is reached by the different size of two ends of stepped piston 82. The small end operates in high pressure chamber 114, and the big end operates in low pressure chamber 117. High pressure chamber 114 is connected to the oil pressure measuring fitting 116 by channel 119 in shell 81. The drain fitting 118 is connected to the internal area 175 of piston 82 via drain channel 120. The cam mechanism includes the flywheel 86, the roller 100, the antifriction sleeve 101, casing 107 (with internal area 176) and converts the rotary motion of the flywheel 86 into reciprocating motion of the piston 102 of the low pressure chamber and the stepped piston 82 of the hydraulic cylinder mechanism. The low pressure chamber 117 is formed by the cavity of the fitting 110, the high pressure hose 83 and the low pressure cylinder 84 with is sealed by the rings 104. It transfers pressure from the piston 102 of the low pressure chamber to the stepped piston 82 without rigid fixation of the hydraulic cylinder mechanism 81. Since the hydraulic cylinder housing 81 is rigidly fixed to the jacket 95, which is rigidly attached to the pipe 36, the flexibility of the high pressure hose 83 will allow suitable placement of the flywheel 86 in close proximity to the jacket 95.

Figure 6:
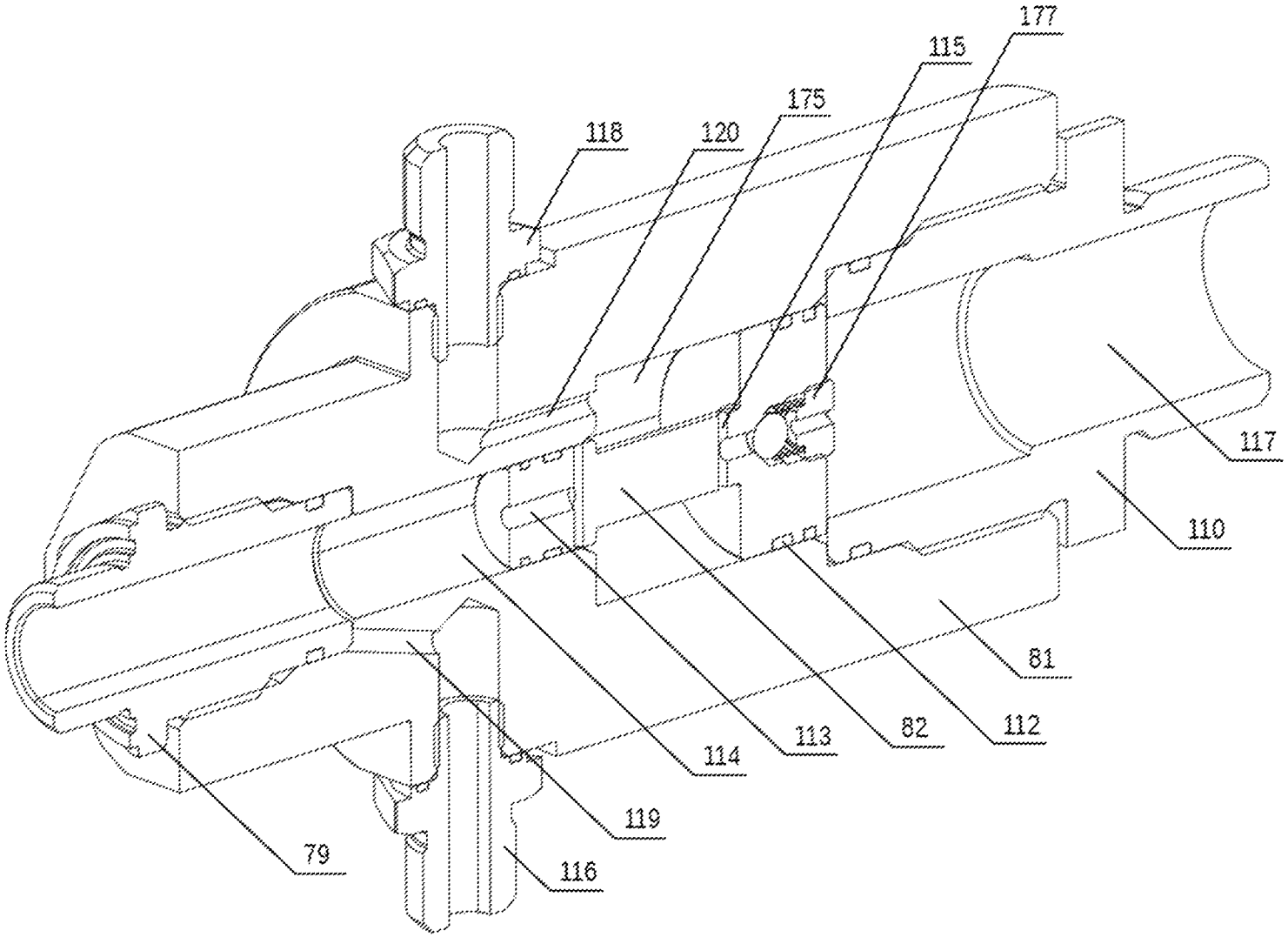
FIG. 6 is a perspective view of a stepped hydraulic cylinder.

Referring to FIG. 6, a stepped hydraulic cylinder 81 is screwed into the jacket through the adapter fitting 79. A stepped piston 82 has two ends with different piston areas. The small end of the piston 82 operates in a pressure chamber 114 connected to a chamber 80 inside the jacket. The big end of the piston 82 operates in the low pressure chamber 117. Such form of the stepped piston creates a significant increase of the pressure inside the high pressure chamber 114. It should be understood that an alternative mechanism, e.g., a vibration actuation mechanism, or the like, could be used to create pressure changes to be transferred to the jacket. According to Pascal's law, the pressure exerted on a liquid or gas is transmitted equally in all directions. Therefore, the area of the big end of the piston 82 allows a large force to be accumulated and applied to the small end of the piston 82. The force at the small end of the piston will be proportional to the area ratio of the small and big ends, providing an amplification $K=S_1/S_2$, where $S_1$ and $S_2$ are areas of the big and small ends of the piston correspondingly. A stepped piston with O-rings 112 has a check valve 177 designed to fill the system with working fluid. A drain fitting 118 is connected to the internal cavity of the cylinder 175 by a drainage channel 120. A fitting 116, a channel 119 and matchmark at the end of the fitting 79 allow to measure pressure in the high pressure chamber 114. Drain channels 113 and 115 compensate temperature changes of fluid volume and possible oil leaks. Stepped cylinder mechanism 81 has a fitting 110 for connecting a pressure hose.

Figure 7:
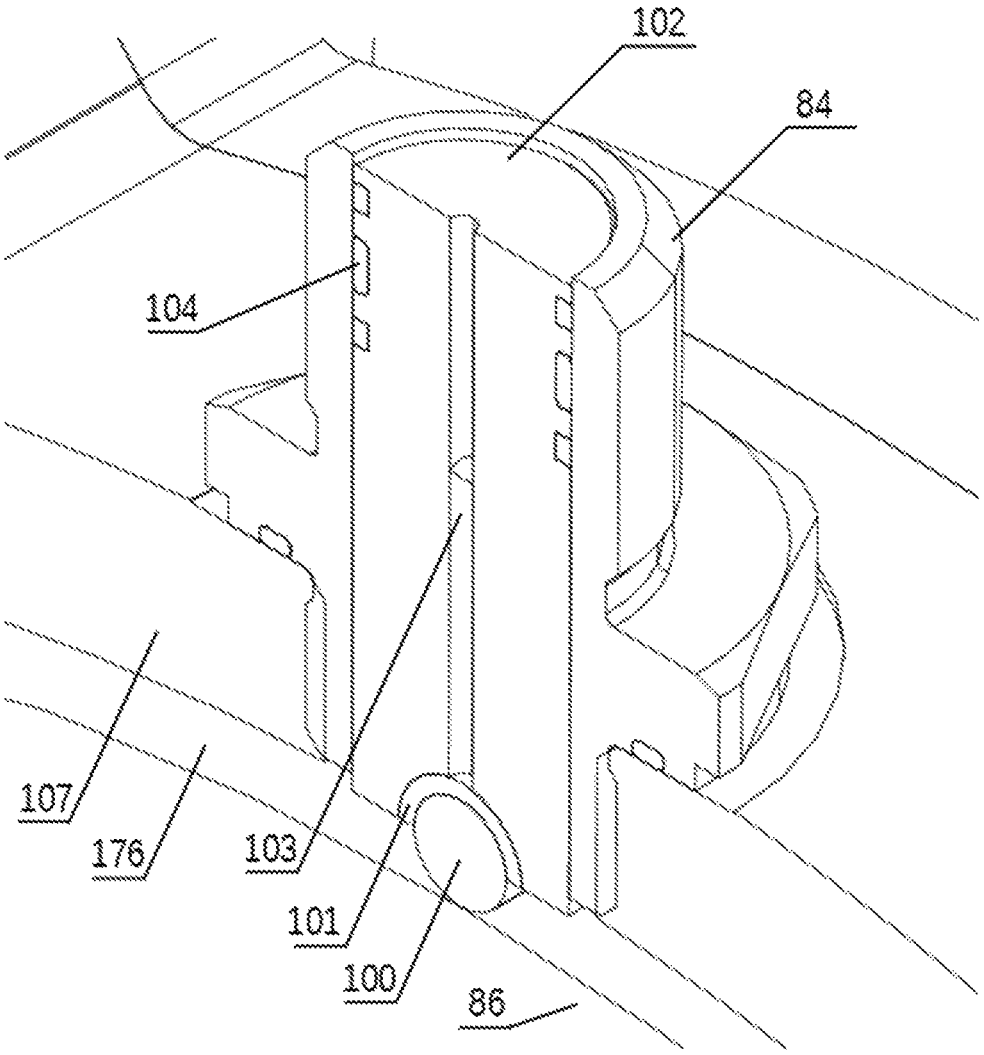
FIG. 7 is a perspective view of a low-pressure cylinder.

FIG. 7 is a three-dimensional (3D) view of low-pressure cylinder 84 embedded into flywheel casing 107 of flywheel 86. A piston 102 is installed inside fitting 84. The piston 102 includes scaling made by O-rings 104. The piston 102 is attached to the anti-friction sleeve 101 and roller 100 connected the cam 86, the rotation of which moves the piston 102. Drain channel 103 compensates temperature changes of fluid volume and possible oil leaks by connecting internal chamber 176 of the cam and low pressure chamber.

Figure 8:
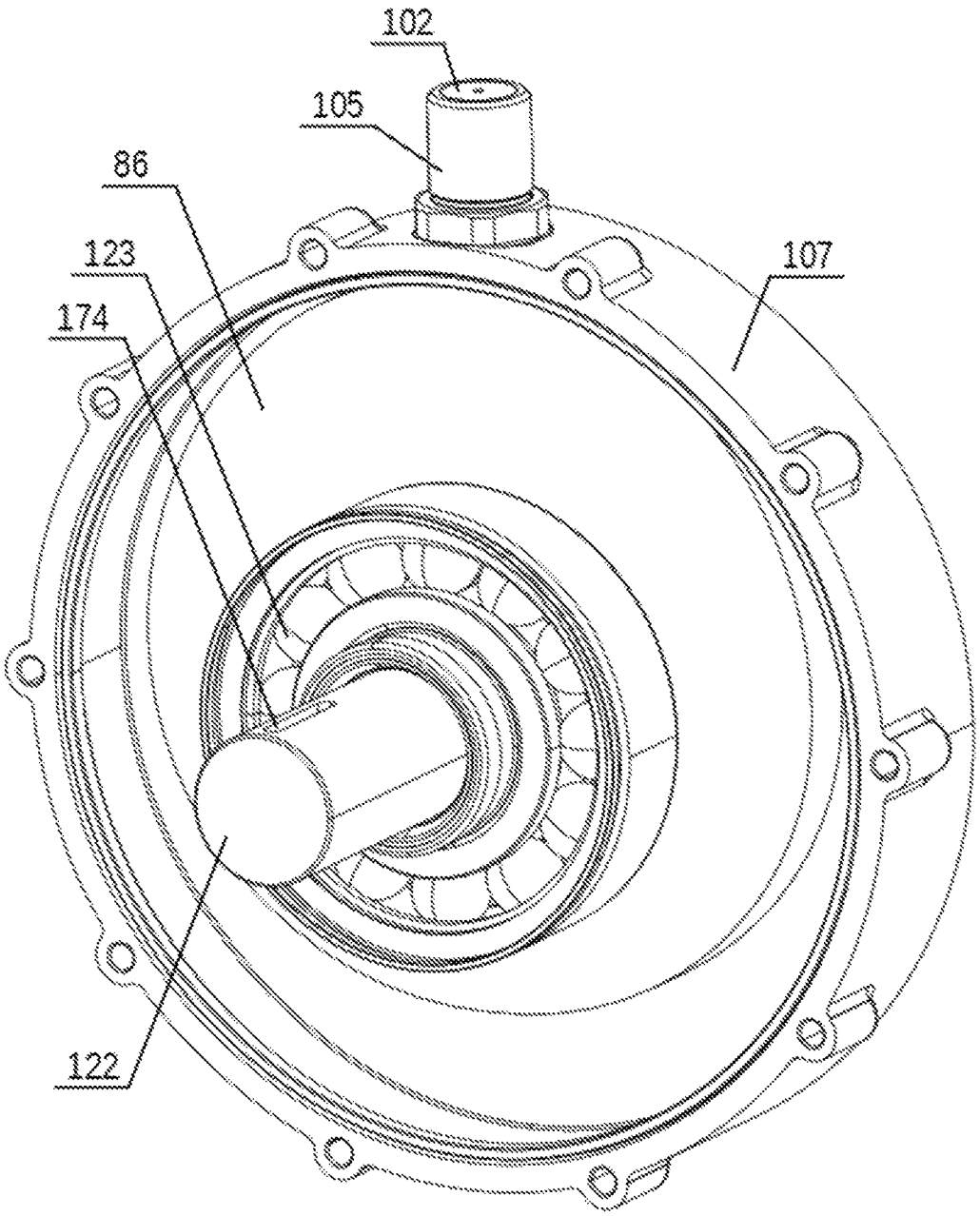
FIG. 8 is a perspective view of a freewheel mechanism.

FIG. 8 shows cam mechanism with flywheel 86 that moves the piston 102 during rotating motion. The cam 86 is fixed in the rolling bearings 123. At the end of the shaft 122 there is a keyway 174, designed to install a coupling for transmitting torque from the electric motor 74 (shown in FIG. 3A, FIG. 3B, FIG. 5, and FIG. 6). Low pressure cylinder 105 is embedded into flywheel casing 107.

Figure 9A:
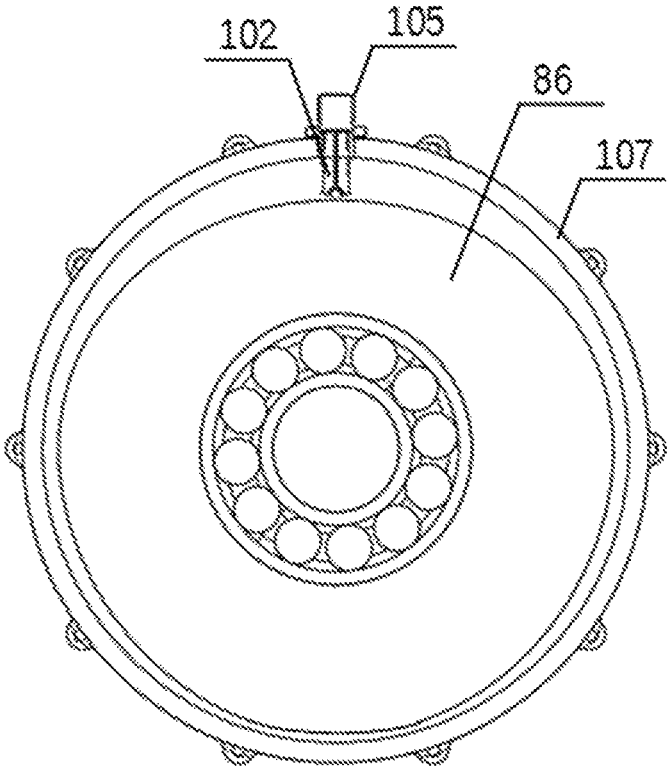
FIG. 9A is a perspective view of a cam in a lower position.
Figure 9B:
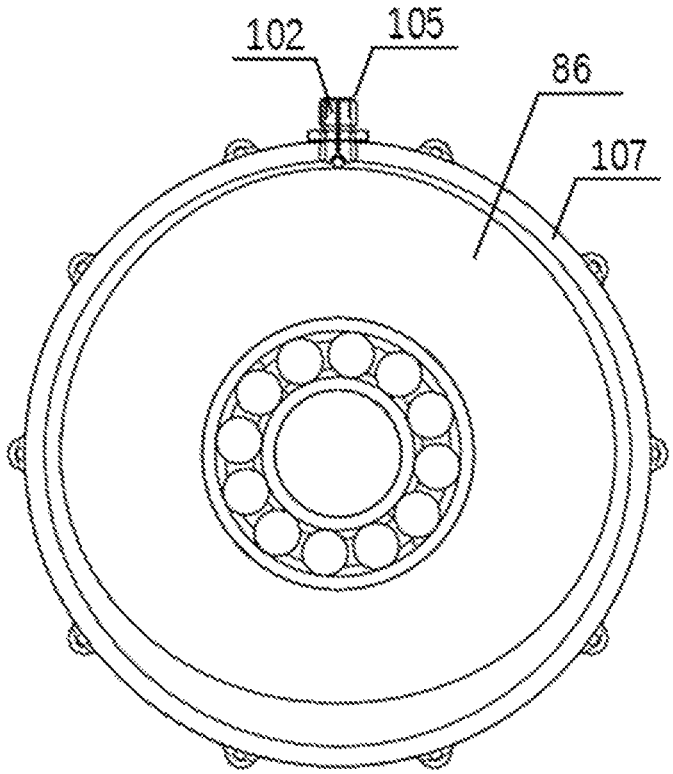
FIG. 9B is a perspective view of a cam in an upper position.

The rotation of the cam 86 inside the casing 107 from the position shown in FIG. 9A to the position shown in FIG. 9B causes the piston 102 to move inside the low pressure cylinder 105, the corresponding increase in pressure in the low pressure chamber 117, and the movement of the stepped piston 82. The cam shape is configured to move a piston in such way that the pressure in the chamber 80 is changed according the harmonic law. FIGS. 9A and 9B show the cam 86 in the lower and upper positions correspondingly. Upper side of the cam 86 is connected to the bottom side of the piston 102 which moves inside low pressure chamber 105.

Below is additional information describing the operation modes of the modulator 51, including the exemplary requirement for power, number of revolutions and selection of working fluid, based on the structure illustrated in FIGS. 3A-9B.

The initial oil pressure in the chambers of low pressure 117, high pressure 114, the drainage cavity of the stepped cylinder 175 and the drainage cavity of the flywheel housing 176 is the same and equal (or substantially the same and equal) to the pressure in the container—the oil tank. This is achieved by drain channels 113 and 103 in pistons 82 and 102, respectively. Starting the electric motor rotates the cam 86. Due to the curvature of the side profile of the cam 86, the low pressure piston 102 starts moving from bottom dead center (FIG. 9A) to top dead center (FIG. 9B). The difference between upper and lower positions of the cam 86 equals to the stroke of a piston 102 in low-pressure chamber 105. As this movement proceeds, the oil in the low pressure cavity 117 begins to compress, which drives the stepped piston 82. Since the high pressure cavity 114 is closed, as the stepped piston 82 moves, the oil is compressed and the pressure in this chamber rises to a maximum value. In this case, the low pressure piston 102 reaches top dead center, and the stepped piston rests with its shoulder against the stepped cylinder 81. An increase in pressure in the cavity of the jackets 80 leads to deformation of the flow line pipe, which starts generating pressure wave in the drilling mud. With further rotation of the cam 86, the reverse movement of the piston 102 and piston 82 begins with a gradual decrease in pressure until the piston 102 reaches the bottom dead center (FIG. 9A) and until the piston 82 stops in the fitting 110. When the pistons reach these extreme positions, the high-pressure cavity is connected 114 through channel 113 with the drain cavity of the stepped cylinder 175 and low pressure cavity 117 through the channel 103 with the drainage cavity of the flywheel 176. The pressure in all cavities equalizes again to the pressure in the tank, compensating for any temperature changes in the oil volume and possible leaks. Each subsequent rotation of the cam 86 again causes the described pressure rise-fall cycle, leading to the occurrence of harmonical pressure waves in the pipe 36.

For the modulator 51, an asynchronous three-phase electric motor with a squirrel-cage rotor, such as AIR 200 M8 18.5 kW 750 rpm, could potentially be used; although alternative motors could be used as well. Rotational speed must be not lower than the maximum required frequency of the generated pressure harmonical waves. The minimum engine power can be calculated using the formula $W=2Vp_{max}F_{max}$, where V is the volume of the high pressure chamber, $p_{max}$ is the maximum pressure in the high pressure chamber, and $F_{max}$ is the maximum frequency of harmonic signal.

Reducing the rotational speed of the electric motor can be carried out by a frequency converter, which is selected from the condition of matching the power to the selected electric motor. The coupling (not shown) for torque transmission is allowed of any design, selected from the following considerations: a) by torque, equal to the ratio of engine power to the pulsation frequency, and b) must allow misalignments that occur with the selected method of mounting the flywheel and electric motor.

The working fluid (oil) is selected based on the allowable temperature range of its operation, taking into account climatic factors and heating during operation. The viscosity of the oil in the considered temperature range should not exceed 500 cSt, and should not fall below 5 cSt. One example of oils that meet these requirements is SHELL Tellus OilsT-15 and MOBIL DTE 11M, although alternative oils can be used.

Figure 10:
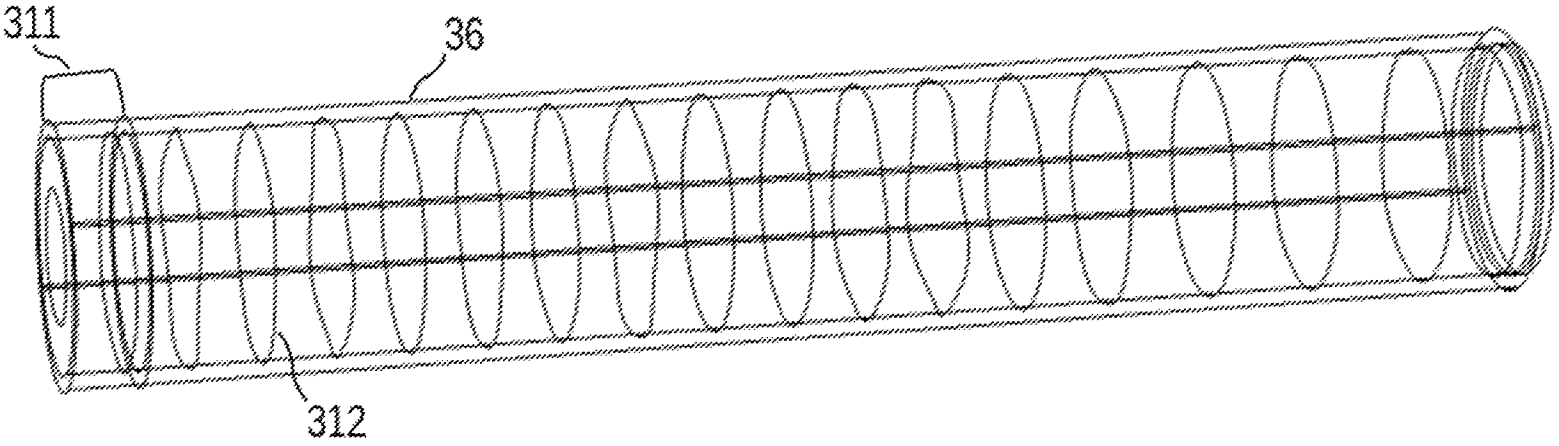
FIG. 10 shows pressure waves propagating along a pipe away from an area of external pressure.

FIG. 10 shows pressure waves 312 (surfaces of equivalent pressure) of the drilling fluid created by radial external force applied to the outside surface of cylindrical section 311 of the pipe 36. Pressure waves propagate from the center of disturbance along the pipe. Due to symmetry and radial direction of applied external force, the surfaces 312 of equal pressure are almost parallel to each other.

Such application of the external force on the pipe can be modeled in Multiphysics engineering software, such as COMSOL (Multiphysics Inc., C., 2020. COMSOL, Available at: http://www.comsol.com/products/multiphysics/), using modules for solid mechanics and pressure acoustics. The software is used to calculate the pressure of a compressible lossless fluid flow using the mass conservation equation (continuity equation), the momentum conservation equation (Euler's equation), and the energy equation (entropy equation). These are given by Equations 15, 16 and 17:

$$\frac{\partial \rho}{\partial t} + \nabla \cdot (\rho u) = M \tag{15}$$

$$\frac{\partial u}{\partial t} + (u \cdot \nabla)u = -\frac{1}{\rho}\nabla p + F \tag{16}$$

$$\frac{\partial s}{\partial t} + \nabla \cdot (su) = 0 \tag{17}$$

where ρ is the total density, p is the total pressure, u is the velocity field, s is the entropy, and M and F represent possible source terms.

The charts in FIGS. 11A-E illustrate the results of pressure calculations for a pipe with an outer diameter of 172 mm, an inner diameter of 154 mm, and a wall thickness of 9 mm for different input parameters. In each instance, the length of the jacket is measured as the distance parallel to the central longitudinal axis of the pipe along which the jacket is positioned against at least a portion of the outer surface of the pipe.

Figure 11A:
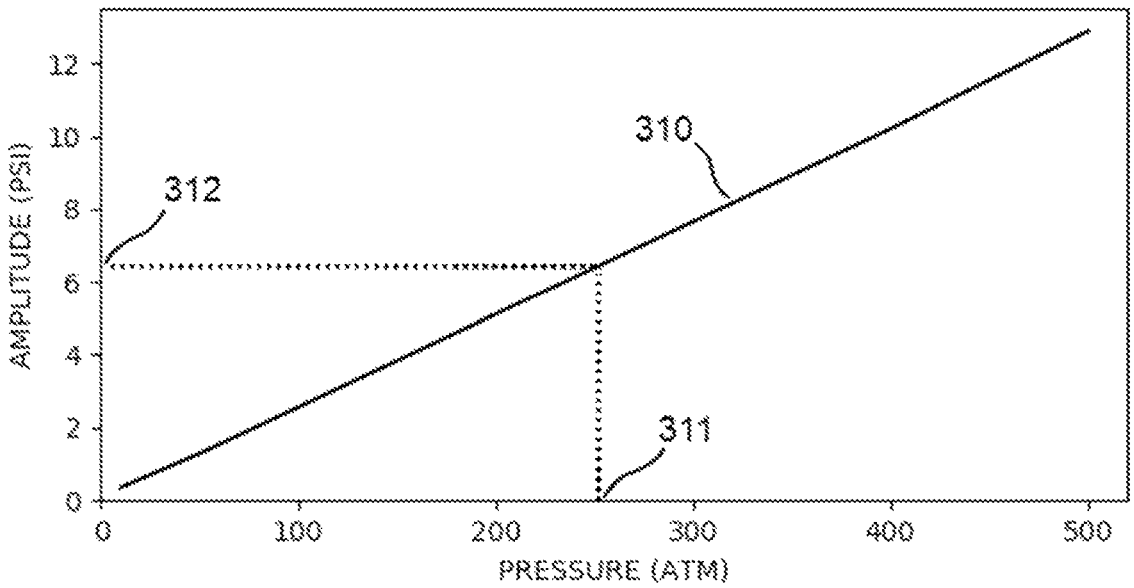
FIG. 11A is a graph of the dependence of the maximum amplitude of pressure waves in the drilling mud from the maximum of oil pressure in the modulator jacket.

FIG. 11A is a chart showing the maximum amplitude 310 of pressure waves in the drilling mud versus the maximum oil pressure in the modulator jacket for a frequency of 10 Hz and a jacket length of 50 cm. Thus, for pressure 250 atm (310) in chamber 80, the output amplitude of pressure waves inside the pipe will be 6.5 psi (312).

Figure 11B:
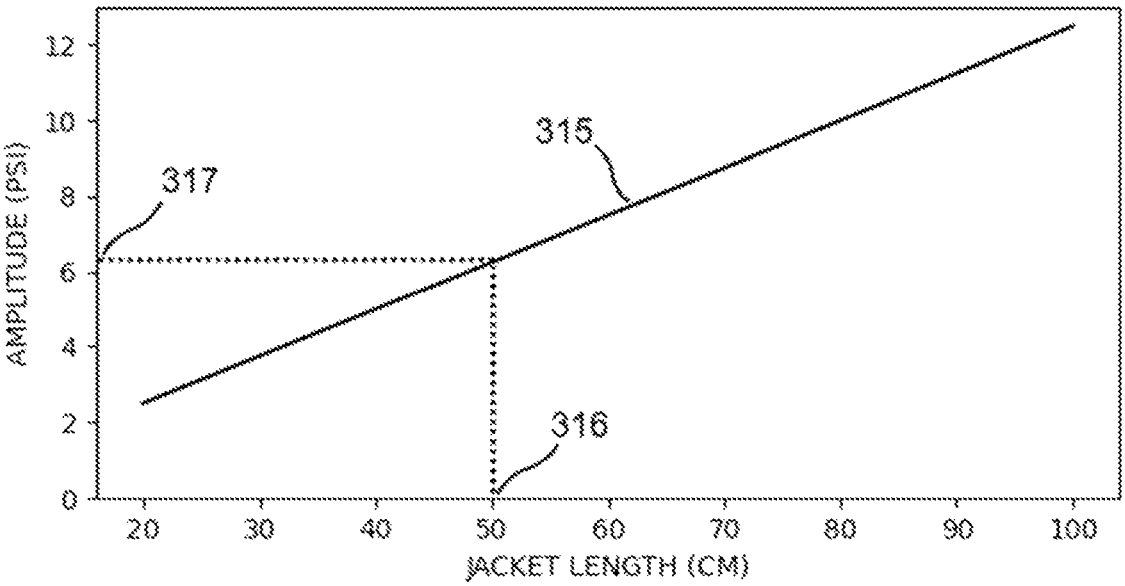
FIG. 11B is a graph of the dependence of the maximum amplitude of pressure waves in the drilling mud from the length of the modulator jacket.

FIG. 11B is a chart showing the maximum amplitude 315 of pressure waves in the drilling mud versus the length of the modulator jacket for a frequency of 10 Hz and an oil pressure in modulator of 250 kg/cm$^3$. The jacket with length L=50 cm (316) creates pressure waves with amplitude 6.5 psi (317) inside the pipe.

Figure 11C:
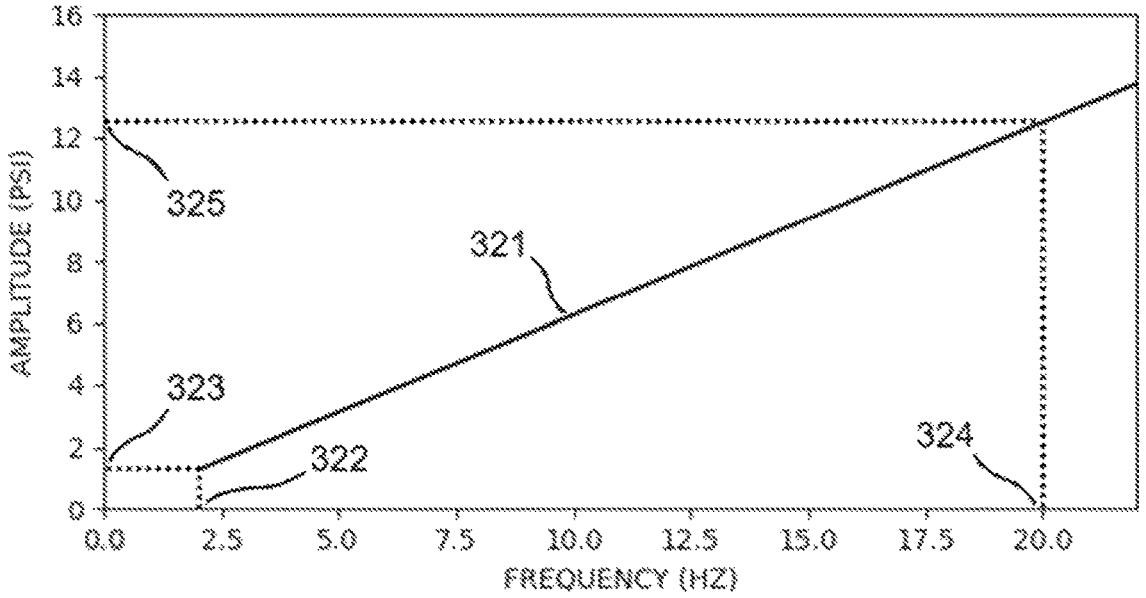
FIG. 11C is a graph of the dependence of the maximum amplitude of pressure waves in the drilling mud from the frequencies generated by modulator.

FIG. 11C is a chart showing the maximum amplitude (321) of pressure waves in the drilling mud versus the frequencies generated by modulator for a jacket length of 50 cm and a pressure in jacket of 250 kg/cm$^3$. For the lowest frequency F=2 Hz (322) the amplitude of pressure waves is equal 1.4 psi (323). High frequency of the modulator, for example, F=20 Hz (324), the amplitude will be equal to 12.7 psi (325).

Figure 11D:
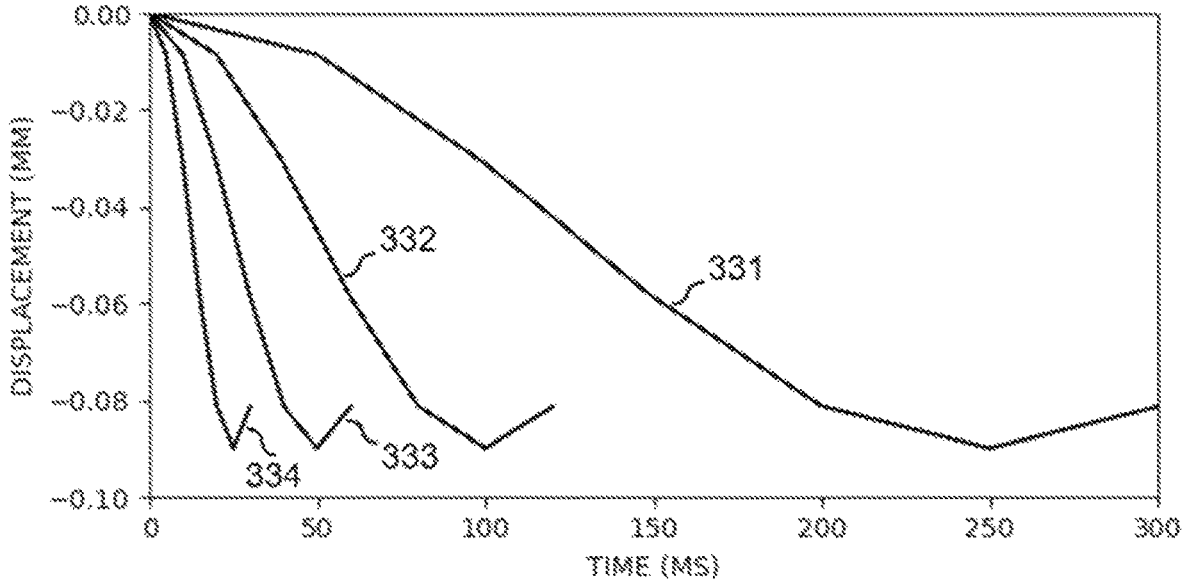
FIG. 11D shows a graph of the pipe wall displacement created by a jacket for frequencies 2, 5, 10 and 20 Hz.

FIG. 11D illustrates the displacement of the pipe wall created by external pressure 250 kg/cm$^2$ versus time for frequencies 2 Hz (331), 5 Hz (332), 10 Hz (333) and 20 Hz (334). The displacement does not depend on frequency. Corresponding stress is less than the fatigue limit of steel—a safe stress below which failure will not occur. For example, the fatigue limit of steel can be equal to 500 MN/m$^2$ (or 5098.58 kg/cm$^2$) as depicted in, e.g., Kalpakjian, S., Manufacturing Engineering and Technology, 3rd Edition. Addison-Wesley Publishing Co., 1995, page 83.

Figure 11E:
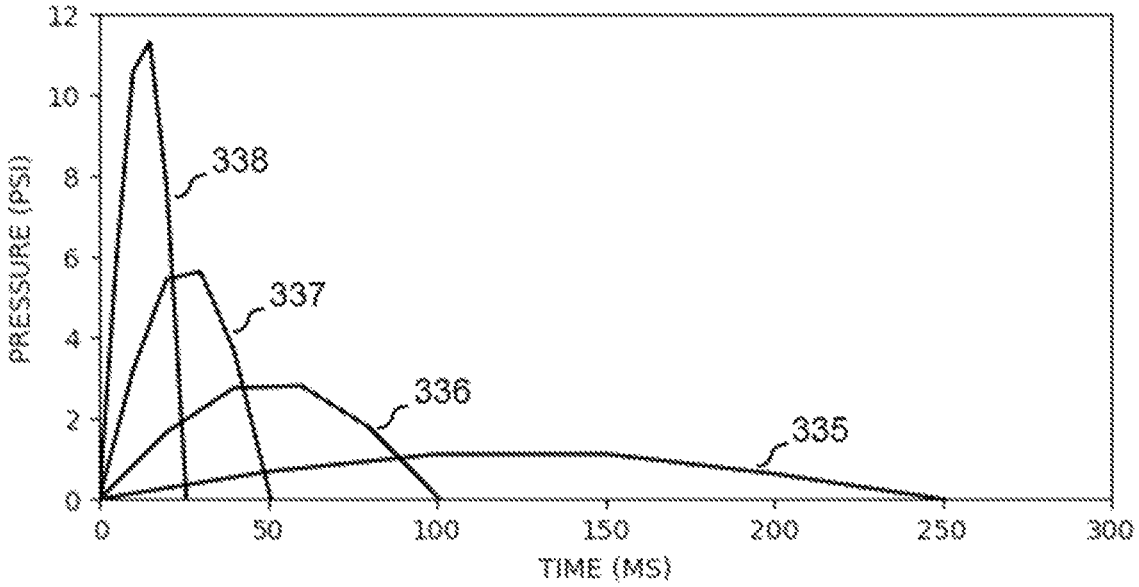
FIG. 11E shows a graph of the drilling fluid pressure inside the pipe for frequencies 2, 5, 10 and 20 Hz.

FIG. 11E shows the amplitude of the drilling fluid waves created by modulator inside the pipe versus time for frequencies 2 Hz (335)—1 psi, 5 Hz (336)—2.6 psi, 10 Hz (337)—5.8 psi, and 20 Hz (338)—11.6 psi. These dependencies determine the lower limit $F_{min}$ of the frequency range depending on pressure inside the jacket. The resulting value of $F_{min}$ must provide downhole pressure wave amplitude $P_{min}$ at the measured depth $H_{max}$ 10-15 times greater than sensitivity of downhole pressure transducer. For example, for a pressure transducer with sensitivity 0.01 psi, $P_{min}$ must be equal to 0.10-0.15 psi at the maximum depth $H_{max}$.

Signal generated by the device 51 propagate in the form of harmonic pressure waves inside the drill fluid acoustic channel. In the process of propagation, the amplitude of the downlinking signal decreases tens (or even hundreds) of times. Signal attenuation restricts application of the most of prior art methods. For example, a detection of individual negative pulses is feasible only by using expensive and bulky equipment, and large pulses with amplitude 300-600 psi which negatively affect mud pump operation. The present invention allows for use of pressure wave harmonics with an initial amplitude just 1 psi for 2 Hz and 10 psi for 20 Hz.

The attenuation of the signal increases with the smaller internal pipe diameter, greater compressibility and higher viscosity of drilling fluid, with higher signal frequencies and greater measure depth of the well. Commonly, the effect of the attenuation is calculated by using the following relationship in Equation 18 from Lamb, H., Hydrodynamics, Dover, New York, N.Y. (1945), pages 652-653, which is:

$$P = P_0 \exp\left[-4\pi f\left(\frac{D}{d}\right)\left(\frac{\mu}{K}\right)\right] \tag{18}$$

where, P—signal strength at a surface transducer; $P_0$—signal strength at the downhole modulator; f—carrier frequency of the MWD signal; D—measured depth between the surface transducer and the downhole modulator; d—inside diameter of the drill pipe; μ—plastic viscosity of the drilling fluid; and K—bulk modulus of the volume of mud above the modulator.

Figure 12:
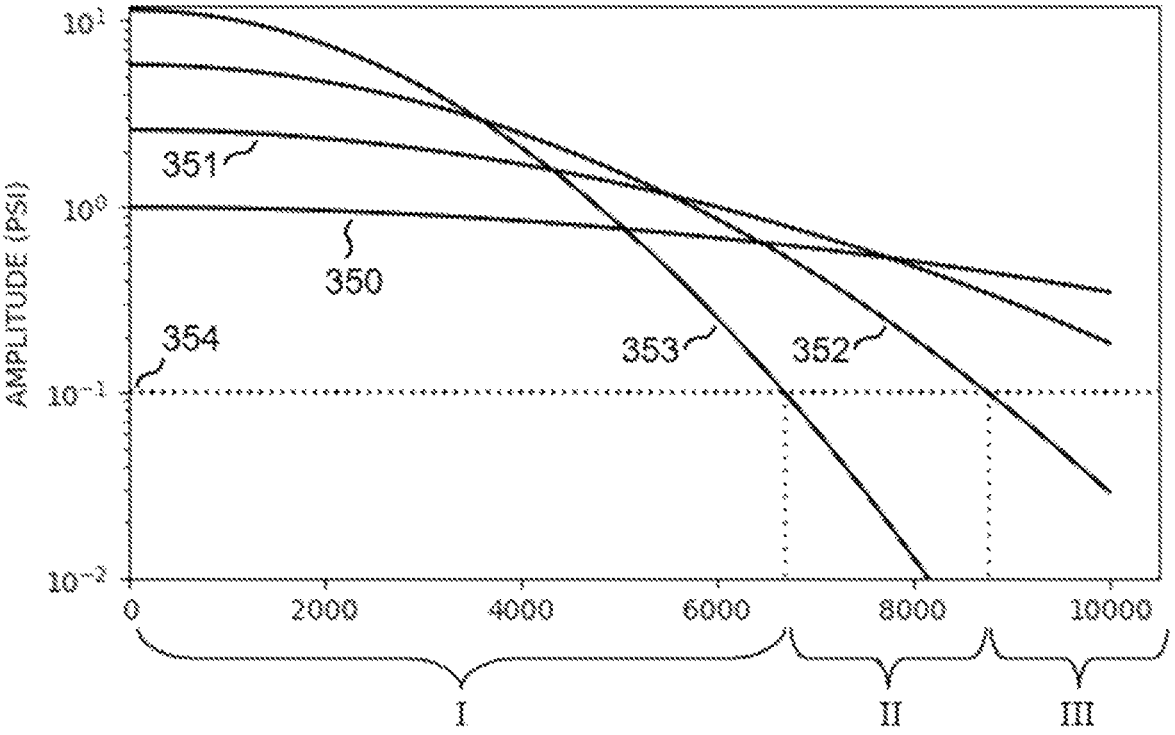
FIG. 12 shows a graph with examples of attenuation for frequencies 2, 5, 10 and 20 Hz, and a division of a well trajectory into sections.

FIG. 12 shows amplitude attenuation (in logarithmic scale) for harmonic 2 Hz (350), 5 Hz (351), 10 Hz (352), 20 Hz (353) versus measured depth calculated for 121 mm (outer diameter) pipe and oil-based mud. In order to select an appropriate range $F_{min}$-$F_{max}$, the minimal detectable level of signal amplitude must be estimated. Typical pressure while drilling sensors have a sensitivity of 0.01 psi. The particular transducers (Quartzdyne) with sensitivity up to 0.001 psi could be utilized for special purposes. FIG. 12 illustrates an example for drilling a deep well (10 km measured depth) and a standard pressure sensor with sensitivity 0.01 psi. For a reliable signal detection with such sensitivity, the amplitude of the signal must be equal or greater than 0.1 psi (line 354). Depth of the point where the line 354 intersects amplitude attenuation curves is a maximum depth at which signal amplitude is equal to 0.1 psi. Using this value as a minimum allowable level of signal, downlink signal is reliably detectable: I) for range 2-20 Hz—up to 6700 m (352); II) for range 2-10 Hz—up to depth 8700 m; III) for range 2-5 Hz—up to 10000 m (351). The above-mentioned example shows maximum measured depth for various frequency components that still provides reliable detection of harmonics with amplitude 0.1 psi (10 times higher than sensitivity of a standard pressure transducer). The present invention allows for detection of low amplitude downlinking signals in the presence of higher level of white noise which is related to operation of drill bit, downhole motor, and fluid movements.

Figure 13A:
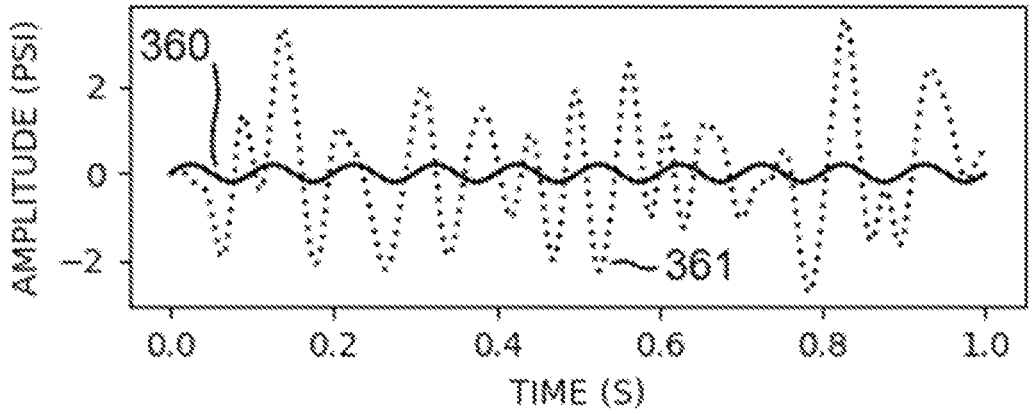
FIG. 13A shows a weak signal F=10 Hz, against a white noise with energy 100 times greater than the signal, and results of Fast Fourier Transform for different time windows of the signal equal to 8 seconds (FIG. 13B), 16 seconds (FIG. 13C), and 32 seconds (FIG. 13D).
Figure 13B:
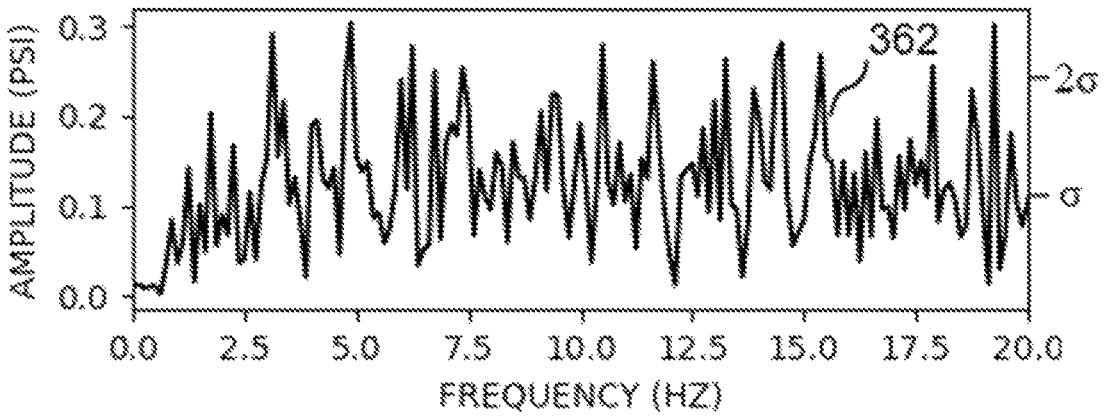
Figure 13C:
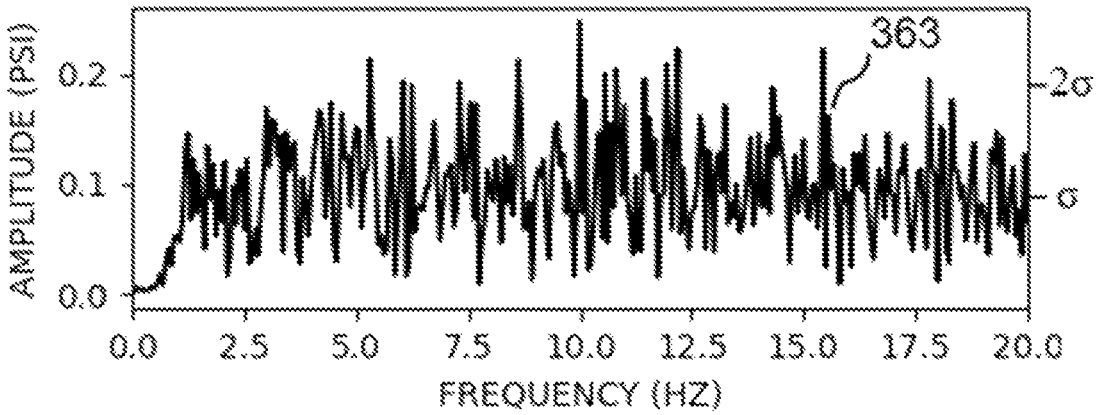
Figure 13D:
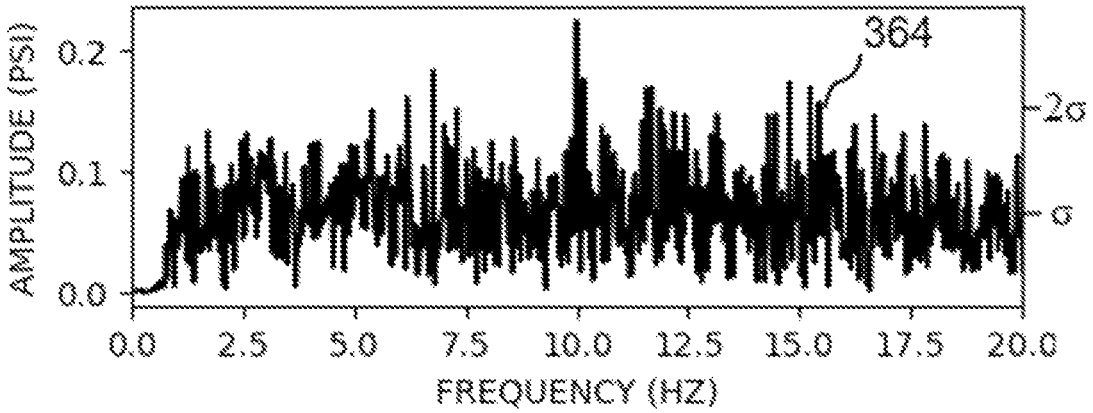

FIG. 13A shows a 10 Hz signal 360 with amplitude 0.2 psi at depth 8000 m and white noise 361. The energy of the noise is 100 times greater than signal energy. FIG. 13B shows results of Fast Fourier Transform (amplitude spectrum 362) for the duration of the signal T=8 s, FIG. 13C—for T=16 s (363), FIG. 13D—for T=32 s (364). The FFT spectrums 362 (for T=8 s) and 363 (for T=16 s) show that detection of a 10 Hz frequency component is not possible because the amplitude of 10 Hz is suppressed by different amplitudes of random noises. Duration T=32 s (364) provides visible detection, but for a robust automatic detection a criteria for it has to be established. In one embodiment, the detection criteria could be $\Delta_{signal}>3*\sigma_{noise}$, where $\sigma_{noise}$ is a standard deviation of the amplitude of white noise in operating frequency range $F_{min}$-$F_{max}$.

Figure 14A:
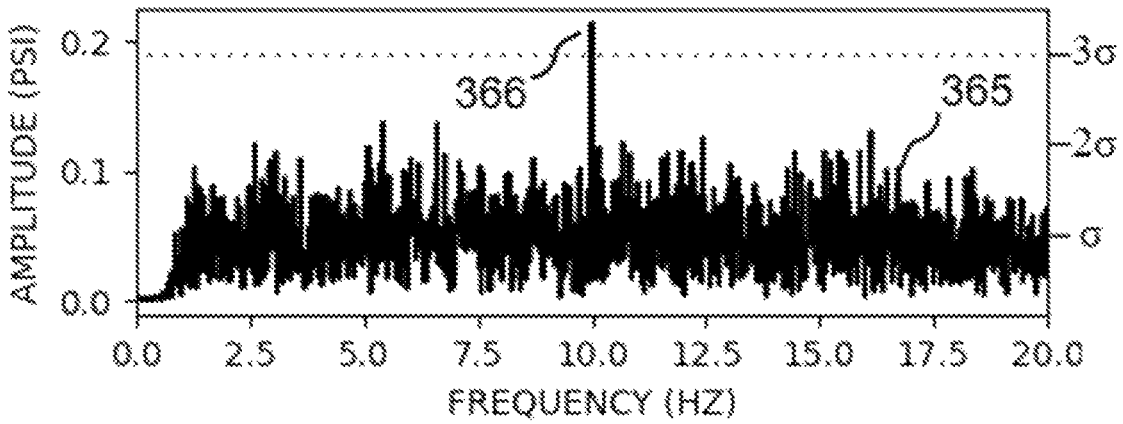
FIG. 14A shows a graph supporting that the time duration for the above example of white noise 100 stronger than a downlinking signal should be equal to 64 sec.

FIG. 14A illustrates the same example for T=64 s (365). The amplitude of 10 Hz component (366) is higher than three standard deviations σ of white noise (365). The equation $\Delta_{signal}>3*\sigma_{noise}$ represents a threshold of robust signal detection. In accordance with theory of useful signal accumulation against the background of white noise, increase of duration by N times causes increase signal/noise amplitude ratio by $\sqrt{N}$ times. If SNR must be increased two times, it is necessary to increase a duration four times.

Figure 14B:
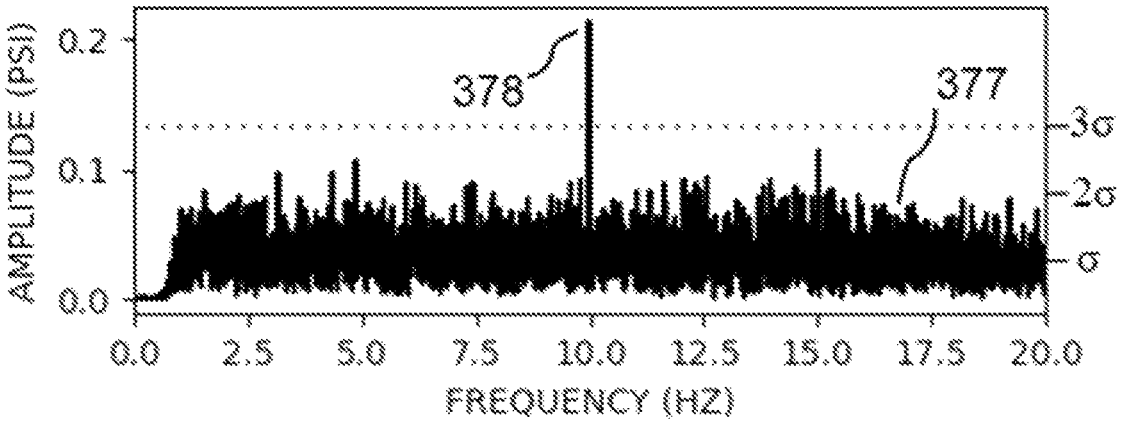
FIG. 14B shows a graph supporting that further increase of the time duration for the above example is redundant.

FIG. 14B for T=128 s shows that component frequency 10 Hz (378) in amplitude spectrum is significantly above $3*\sigma_{noise}$ line of white noise (377). The longer duration of T provides better detectability of downlinking signals, but it is redundant—threshold $3*\sigma_{noise}$ gives 99% probability of correct detection. In practice, with the exception of depth 5 km or higher, the reliable detection is feasible for T=8, 16 or 32 seconds, but if the noise exceeds the signal by 100 times, these durations are not enough (362, 363, 364 in FIGS. 13A-D). It is therefore important to determine how long the duration of the signal 360 should be to satisfy the above mentioned criteria.

Figure 15:
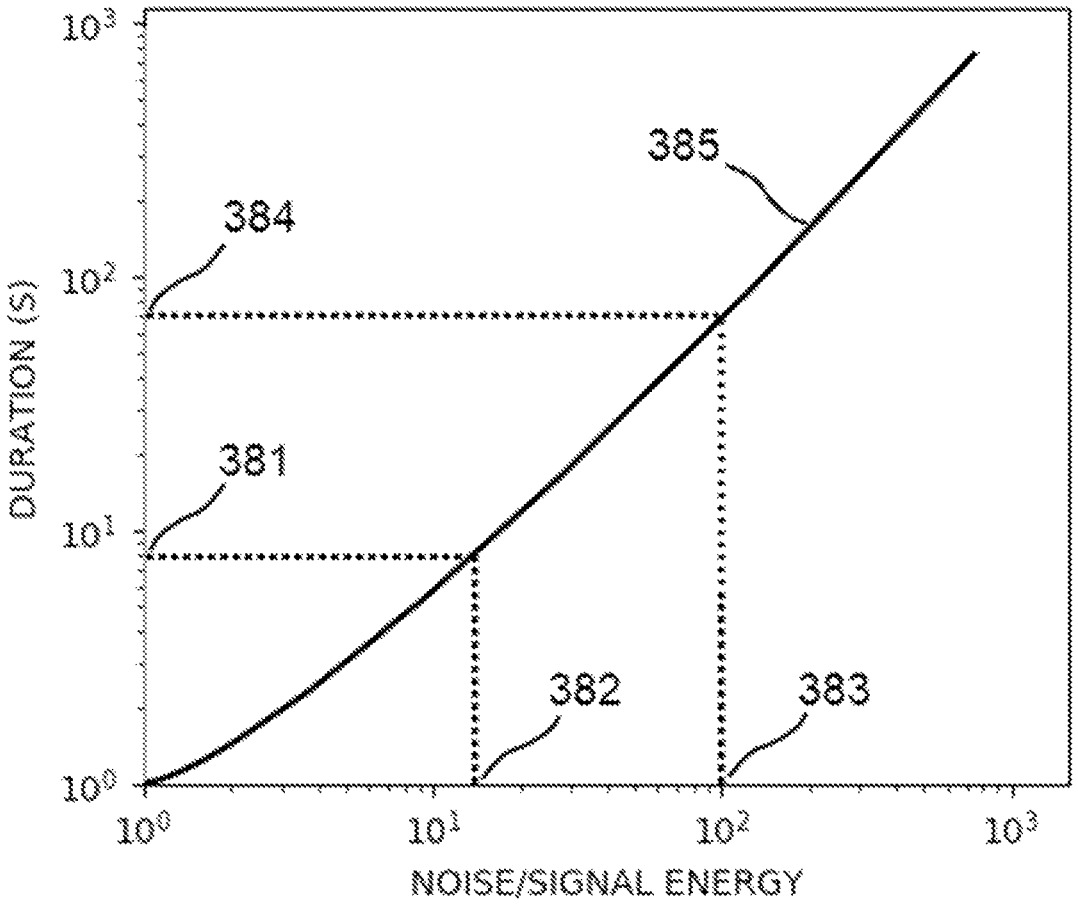
FIG. 15 shows a graph between a white noise-to-signal ratio and a duration of a signal sufficient for reliable detection and decoding of a downlinking signal.

FIG. 15 illustrates signal duration required for signal detection versus noise/signal energy ratio. For example, duration of signal T=8 s (381) allows for signal detection if noise/signal energy ratio is less or equal to 14 (382). If noise/signal ratio is equal to 100 (383), the case which is illustrated in FIGS. 13A-D and FIGS. 14A-B, the criteria $\Delta_{signal}>3*\sigma_{noise}$ is met for duration of signal T=60 s (384).

The maximum frequency $F_{max}$ for downhole communication must provide sufficient amplitude of the signal for a robust detection for at least a half of the well length. At the same time $F_{max}$ must not exceed $F_{gen.max}$ provided by the modulator 51. For the wells with significant length of measured depth it might be necessary to divide well trajectory (as shown by the example illustrated in FIG. 12) by a few intervals. Each interval has its own $F_{max}$. The range of frequencies band $F_{min}$-$F_{max}$ also depends on amount of different downlinking commands which are selected for a particular well. Selection of $F_{min}$ is based on criteria avoiding majority of strong noise generated by surface location pumps. For a typical situations $F_{min}$ could be selected in a range between 2-4 Hz.

For example, FIG. 16 shows the number of available combinations of frequencies depending on the duration T (column 391) of the signal (for $F_{gen.max}$=20 Hz) for words with one letter (393) and two letters (394). Minimum feasible distance between adjacent frequencies (column 392) ΔF=0.125 Hz with duration T=8 seconds provides 152 available combinations for one letter words and 23104 combinations for two letter words in range 2-20 Hz. Frequency step ΔF is determined by precision of the modulator and its capability to produce distinct harmonics with minimal frequency difference. The number of frequencies and/or combinations of frequencies (in case of 2 letters of combinatorial frequencies alphabet) has to greater than the total number of downlinking commands (including their functions and values).

If signal transmission time is 1.0 see (1024 ms if using FFT—it will be simpler because FFT calculations require a number of points equal to a power of 2), the amount of orthogonal harmonic is equal 19 (19*2°), if transmission time will be increased by factor of 2, then amount of orthogonal harmonic doubled 38 ($19*2^1$) and distance between adjacent harmonics Δf will be equal 0.5 Hz. Each time the length of the signal transmission is doubled the amount of orthogonal harmonic is also doubled and distance between nearest-neighbor frequencies reduced by half. For example, if Δf=0.125 Hz, the total amount of orthogonal harmonic is equal 152 ($19*2^3$). Such amount of combinations is greater than a typical amount of instructions (including their value) used traditionally for downlinking in the industry.

The value of Δf minimum depends on the modulator 51 producing a single frequency with a particular accuracy. The value $\Delta f_{min}$ can be determined by predrilling test of the generator accuracy by using data from pressure transducer 52.

The vast majority of modern well trajectory control system in the oil and gas industry, which include equipment for MWD/LWD measuring and RSS, are used to transmit a limited amount of different downlinking commands (typically less than 50-100 different commands). In such cases, for their transmission would be enough to use no more than 128 combinations or 6 bits. It is achievable, for example, to use a frequencies range of 16 Hz with duration of downlinking command equal 8 seconds and Δf=0.125 Hz. In such case, it is possible to use just only single letter of the combinatorial frequency alphabet. If a 2 letter scheme is used for 16 seconds 14 bits information is sent. The above examples demonstrate the speed of sending downlinking commands in the present invention, which is in order of about 1 bit per second as compared with traditional practice which is about 1 bit per minute.

Figure 17:
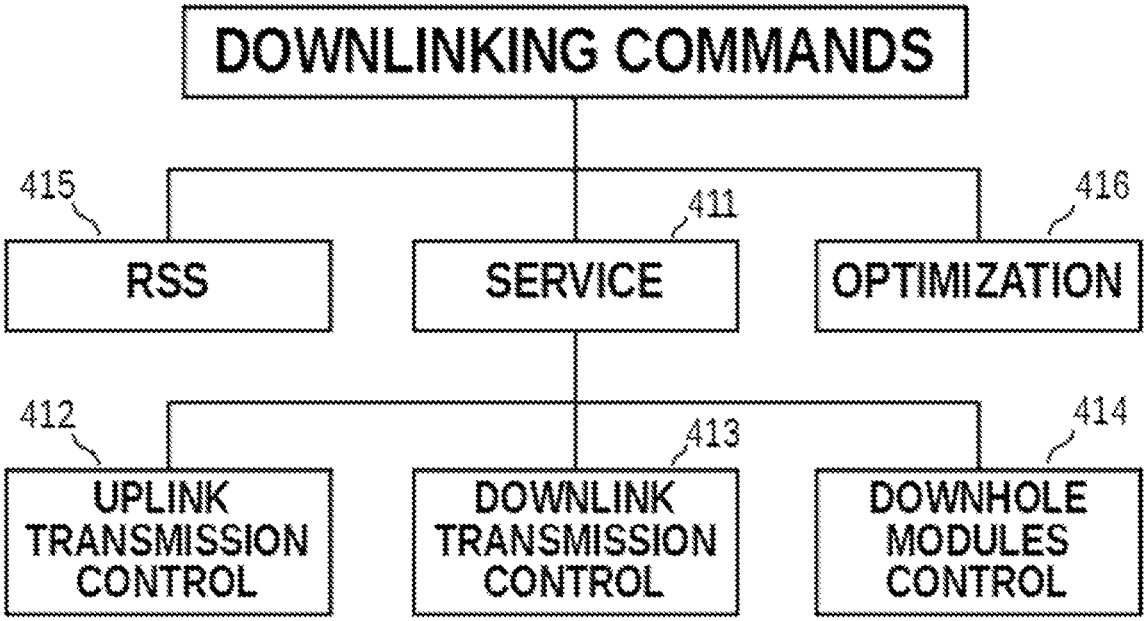
FIG. 17 is a block diagram of various type of downlinking commands, which may be transmitting to downhole transducer to manage acquisition optimization, trajectory control, and other control functions.

A list of required downlinking commands depends on the tools included in BHA, presence of rotary steerable system and objectives of control and optimization of drilling process and data acquisition and transmission. Typically, as shown in FIG. 17, there are three groups of different commands. The group of service commands (411) and a group of RSS control commands (415) are known in the industry. The group of optimization and energy saving commands (416) is a novel group which may be utilized by using fast and robust continuous downlinking method and system disclosed in the present invention. A novel group allows to maintain a balance between density of measurements, rate of penetration and BHA tools energy consumption.

Measurements while drilling process implies making a certain number of measurements (points) per meter according to the specified requirements. For example, requirements may demand not less than 5 points per meter (1 point per 20 cm) of certain parameter measured and transmitted in real-time from the bottom hole to the surface. The telemetry system must provide the required density of measurements regardless of changing drilling conditions, for example, high or low rate of penetration.

Figure 18:
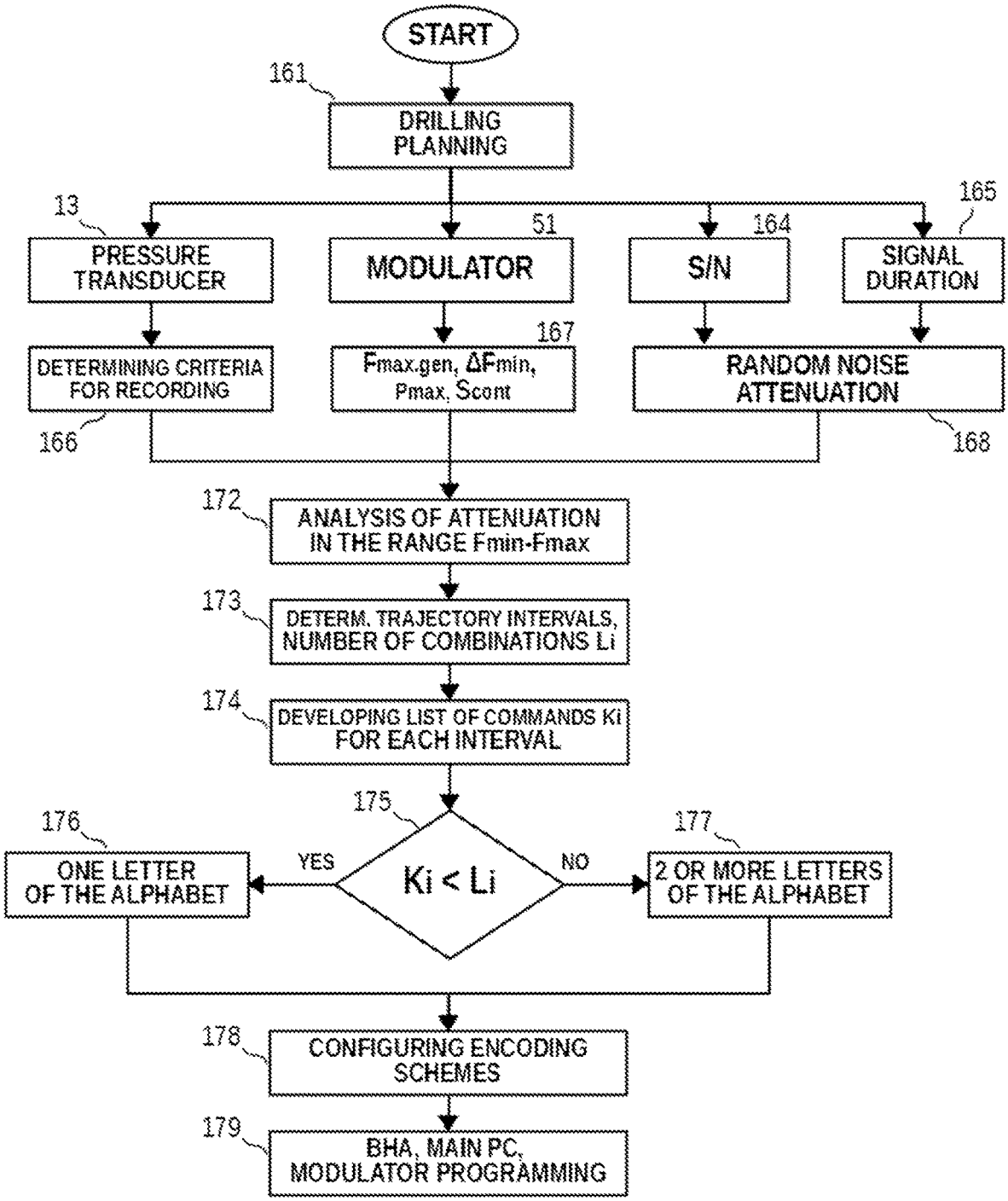
FIG. 18 is a flow chart illustrating steps and their sequence during planning and initialization phases according to the present disclosure.

FIG. 18 illustrates major steps for the planning and initialization stage. Pressure detector (13) requires determining criteria for recording (166). The following parameters must be estimated: maximum frequency $F_{max.gen}$ of the modulator (51), minimal difference between adjacent frequencies $\Delta f_{min}$, and average flow rate $Q_{avg}$ (167). Estimation of signal/noise ratio (164) and signal attenuation (172) allows to choose a proper signal duration (165, 168). The planning trajectory is split into intervals (173) by measured depth, and the number of combinations is calculated. For each interval, the list of commands Ki must be determined (174). If the number of combinations exceeds the number of commands (175), then the combination of command function and value is transmitted via one frequency as a single letter of the combinatorial frequencies alphabet (176). Otherwise, two letters are utilized (177), the first—for command type, the second—for command value. All encoding schemes are configured (178) and programmed (179) into BHA, main PC and modulator controller.

Figure 19:
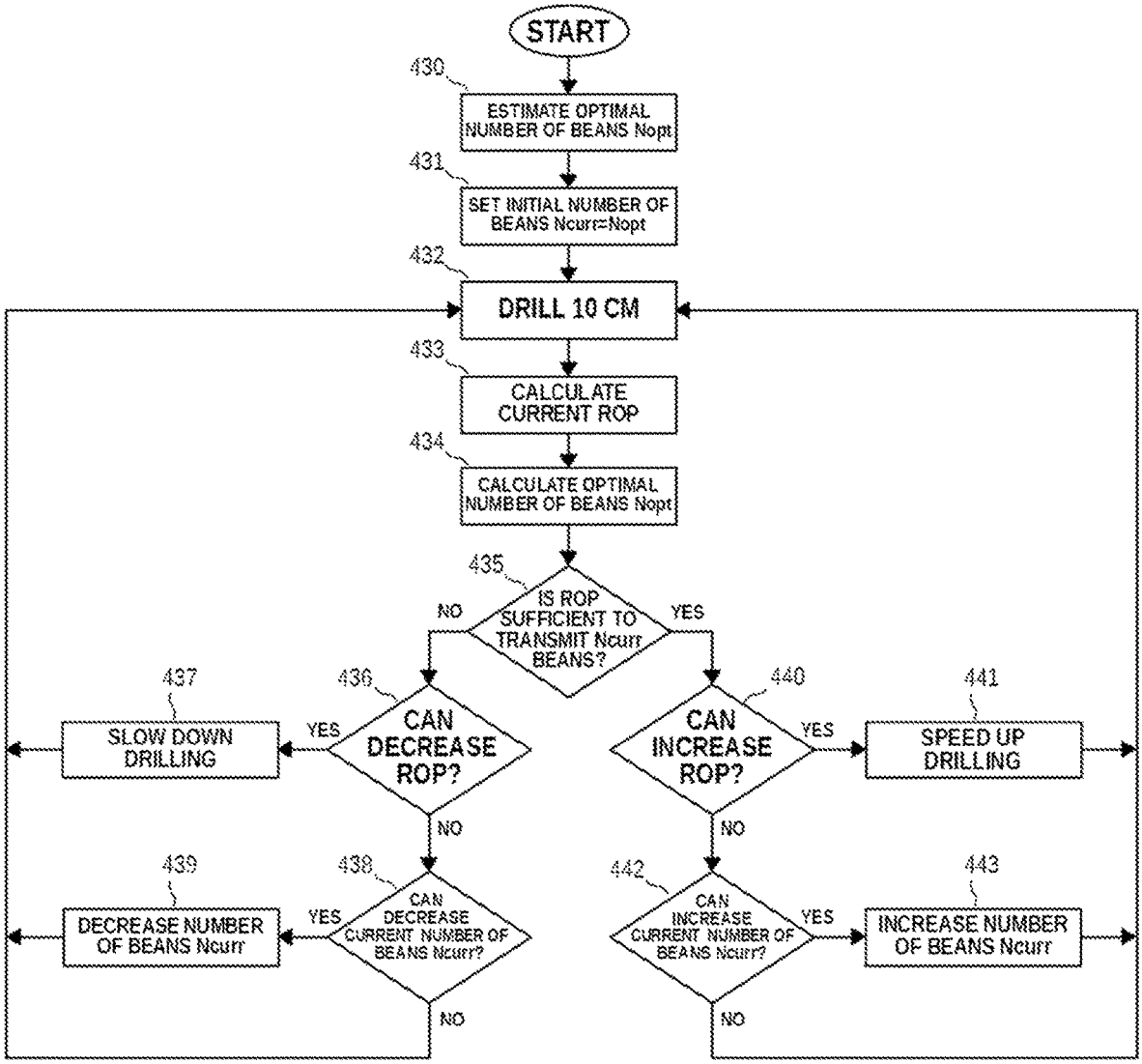
FIG. 19 is a flow chart for optimization of data acquisition during LWD operation utilizing downlinking communication according some embodiments of the present disclosure.

FIG. 19 illustrates the steps of the algorithm providing the balance between the amount of information for uplink transmission and the rate of penetration (ROP). Actual number of information is limited by small bit rate of uplink channel—not all desired information could be transmitted to the surface without delay of the drilling process. If the rate of penetration is high, the drill string may pass the interval rapidly, and required point density is not kept. Therefore, the system must determine and balance between ROP and transmitted information. Initialization step (430) includes estimation of optimal number of information to transmit based on current configuration and prior knowledge. The system in configured to use the optimal number of information for transmitting to the surface (431). Actual value of ROP is calculated (433) for small drilling interval (432). The optimal number of information (for transmitting to the surface) is calculated for the current ROP value (434). The next step includes comparing current and calculated number of information and making a decision how to balance current ROP with required number of measurements per meter (435). If the current rate of penetration is too high or the current bit rate is too low (436) there are two options available: slow down drilling (436, 437) or decrease number of information to transmit (438, 439) via uplink channel. After choosing a decision in accordance with current situation and priorities, the loop is repeated again (432). If the current rate of penetration is small or the current bit rate allows to transmit more information to the surface (440), similarly, the choice between two options—increase ROP (440, 441) or transmit more information (442, 443) must be done in accordance with current situation and priorities.

Figure 20:
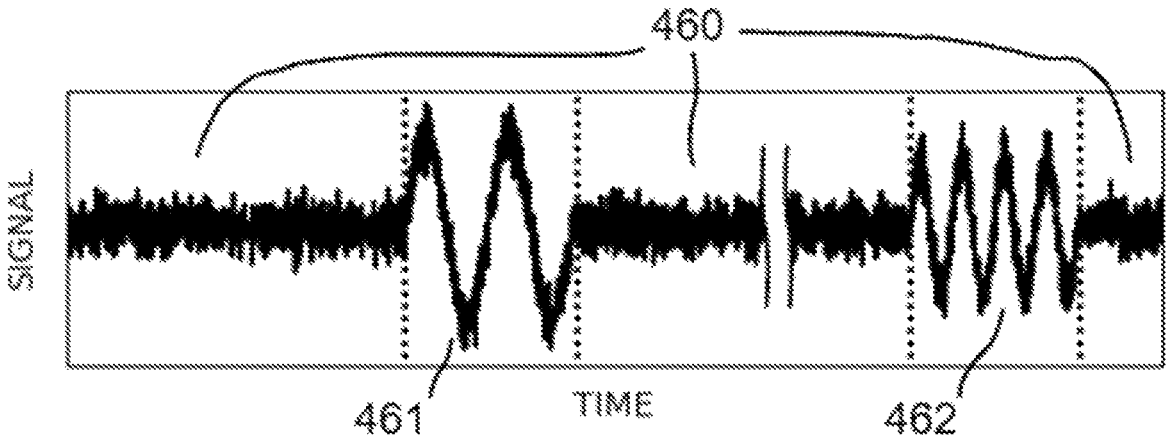
FIG. 20 is an example (white noise is shown with average amplitude less than an amplitude of signal for illustrative purposes) of two successive downlinking commands where the command function and value is represented by one letter of the combinatorial frequencies alphabet.

FIG. 20 is an example (white noise shown with lower amplitude compare to the amplitude of the signals for illustrative purpose) of two different downlinking commands 461 and 462, where a command function and value are encoded by one letter of combinatorial frequencies alphabet. A space between them is filled white noise (460). Downlinking commands have a structure $\{W, F_c, W\}$, where W—white noise (460), and $F_c$—frequency of the command (461, 462) that corresponds to one unique combination of purpose and value of the command. This structure is used if a number of unique frequencies provided by selected range $F_{min}$-$F_{max}$ and ΔF exceeds a total number of combinations "command purpose+command value" calculated above.

Figure 21:
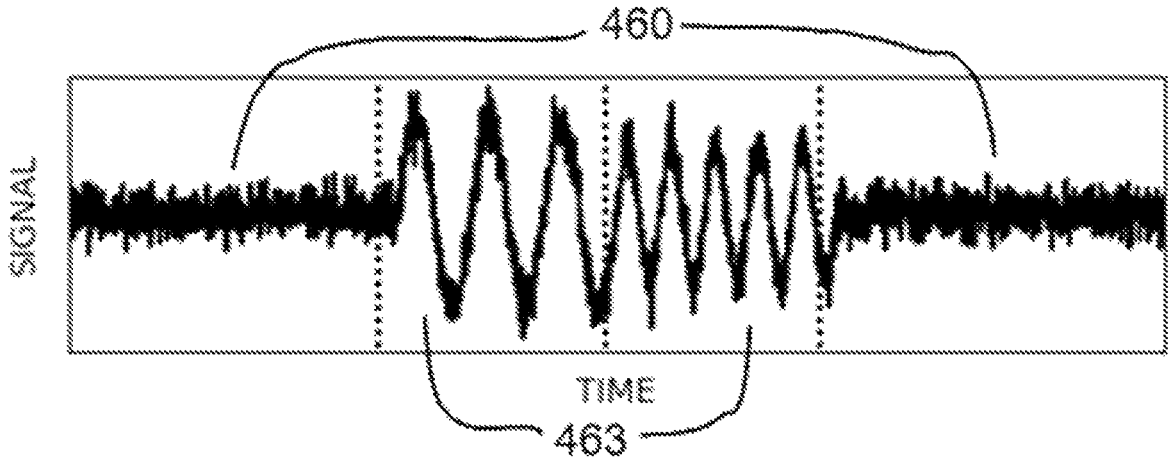
FIG. 21 is an example of one downlinking command, where the command function and value is represented by a word from two letters of the combinatorial frequencies alphabet.

FIG. 21 illustrates a situation in which, for example, in frequency ranges 2-10 Hz and 2-5 Hz, the downlinking command has a structure $\{W, F_g, F_v, W\}$, where W—white noise (460); and $F_g$, $F_v$—purpose and value of the command (463) correspondingly. This structure allows for utilization of the same set of frequencies both to encode command purpose and to encode a command value. The total number of unique combinations will be $L*L=L^2$, where L—a number of frequencies in range $F_{min}$-$F_{max}$. There is no space between command parts.

Figure 22:
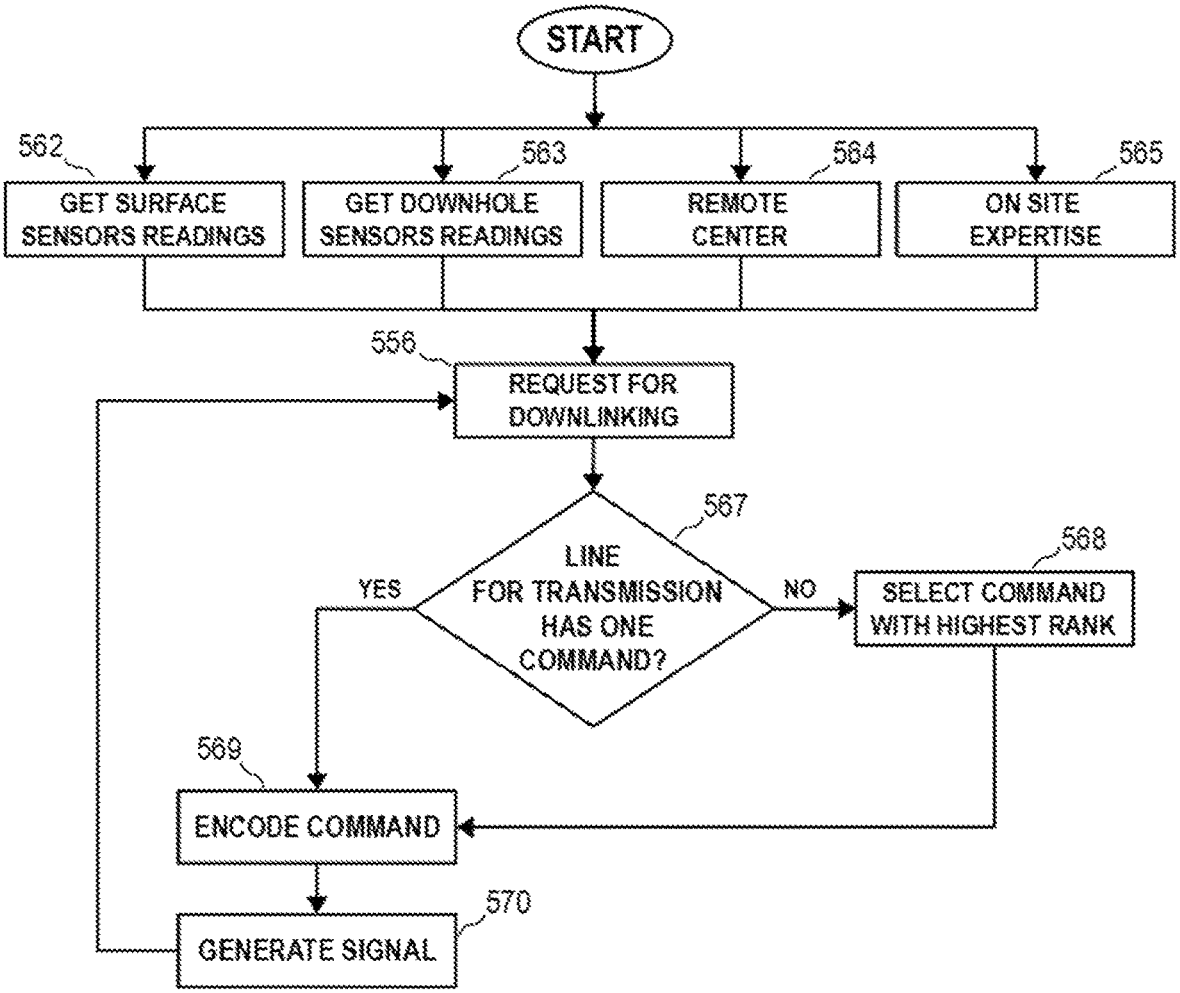
FIG. 22 is a flow chart illustrating sources and logic for developing downlinking instruction according to some embodiments of the present disclosure.

FIG. 22 illustrates the process of generating downlinking commands based on various sources of information and their sequential execution. The surface systems gets readings from various surface sensors (562), information from downhole sensors (563), receives instruction from remote control center (564) and takes into account on site expertise (565). Based on the above information from these sources, the system produces a request for a new downlinking command (556). If, as a typical situation, there is only one request (567) for transmission of a downlinking command, then the command is encoded (569) and executed by generating a downlinking signal by modulator 51. If there are two or more requests for downlinking, then the command with highest ranking is selected (568), encoded (569) and executed (570).

In the present invention all downlinking commands can be divided into three groups:

- general communication commands with highest priority,
- rotary steerable system control commands with second or intermediate priority, and
- data acquisition and power saving optimization commands with the lowest priority.

Based on a particular situation, the priority of different downlinking commands could be changed.

Figure 23:
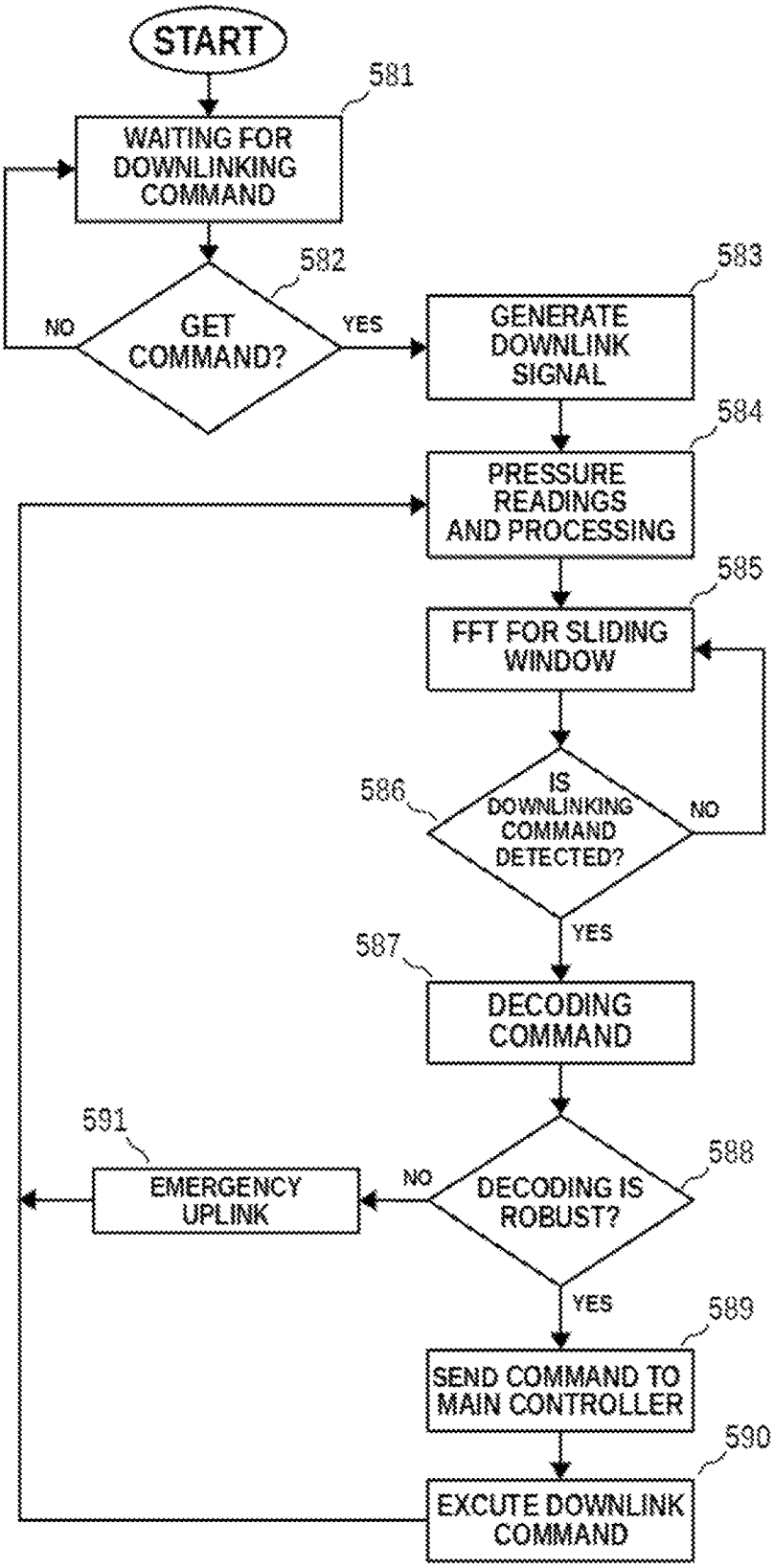
FIG. 23 is a flow chart illustrating components, processing, detection and decoding at the BHA according to some embodiments of the present disclosure.

FIG. 23 is a block diagram to illustrate downhole processing, detection and decoding at the BHA according to same embodiments of the present invention. Key component of BHA 22 responsible for such actions are: pressure sensor 13 and its controller, main controller 16, pulser modular 21, and flow sensor 11. The presence of drilling fluid flow is a mandatory condition for uplink signal transmission. Incorporated into BHA flow sensor waits for mud pumping and detects a state of the fluid flow (581-582), transmits flow-state signals to other downhole modules thereby triggering or stopping operation of receiving new pressure values.

A pressure sensor 13 continuously recording pressure measurements (584) in the presence of flow drilling mud with sampling frequency not less than $fs=2*F_{max}$ in accordance with Nyquist-Shannon sampling theorem, where $F_{max}$ is a maximum frequency in range used for downhole data transmission. The sensitivity of the pressure sensor determines a minimum detectable amplitude of harmonic, and it must be taken into account for estimation of the amplitude of decaying downlink signal. In the example which is used above to illustrate novelty of the present invention, the sensitivity of pressure sensor was assumed as 0.01 psi and minimum detectable downhole amplitude level as 0.1 psi. A controller of the pressure sensor appends new pressure readings into a memory buffer for further processing. It allows to accumulate a sequence of pressure values during time span $t>T_{max}$ (where $T_{max}$ is a maximum signal duration) that is sufficient for analysis.

Pressure readings in the buffer are being constantly monitored for a presence or absence of signal. The processing starts with applying FFT to the selected fragment of signal. Removing zero-frequency component and performing band-pass filter allow to remain only working range of frequency components between $F_{min}$ and $F_{max}$. The presence of a certain frequency is determined by estimation of the corresponding FFT component. A particular firmware module of pressure sensor controller hereafter referred to as "decoder" performs FFT for the window sliding along the time axis with step $\Delta t=1$ second.

The decoder determines the decoded command (586), estimates decoding quality (587), and if criteria of a robust decoding is not satisfied then BHA starts the emergency uplink procedure (591) to inform surface about potential of incorrect decoding of downlinking command. In such case the uplink includes information on decoded command. If downlinking command was decoded incorrectly, the original command is downlinking again by using options to increase signal to noise ratio.

Figure 24:
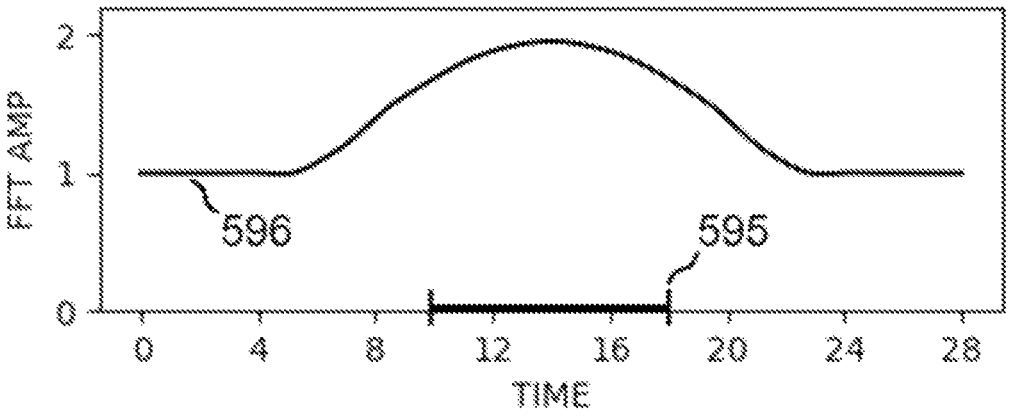
FIG. 24 shows a pattern of signal and white noise behavior of an amplitude spectrum after applying FFT on a sliding base.

The following example illustrates the concept of signal detection. In the example, signal frequency is fs=20 Hz, duration of the signal is T=8 seconds, and it is presumed that amplitudes of fs meet the criteria $A_{signal}>3\sigma_{noise}$. FIG. 24 illustrates the bounds 595 of signal fs=20 Hz on the time axis and corresponding FFF amplitudes (curve 596) for 20 Hz component versus the position of the center of the sliding window. Once sliding window includes fs the dome is forming on the graph 596. The center of the dome allows to determine the center of the signal and its time limits. If downlinking command consists of letters of combinatorial frequencies alphabet, where the first letter is a purpose or type of the command and the second letter is a value or a mode of the command, then the curve 596 will have two maximums with the distance between them equal to T seconds.

Figure 25:
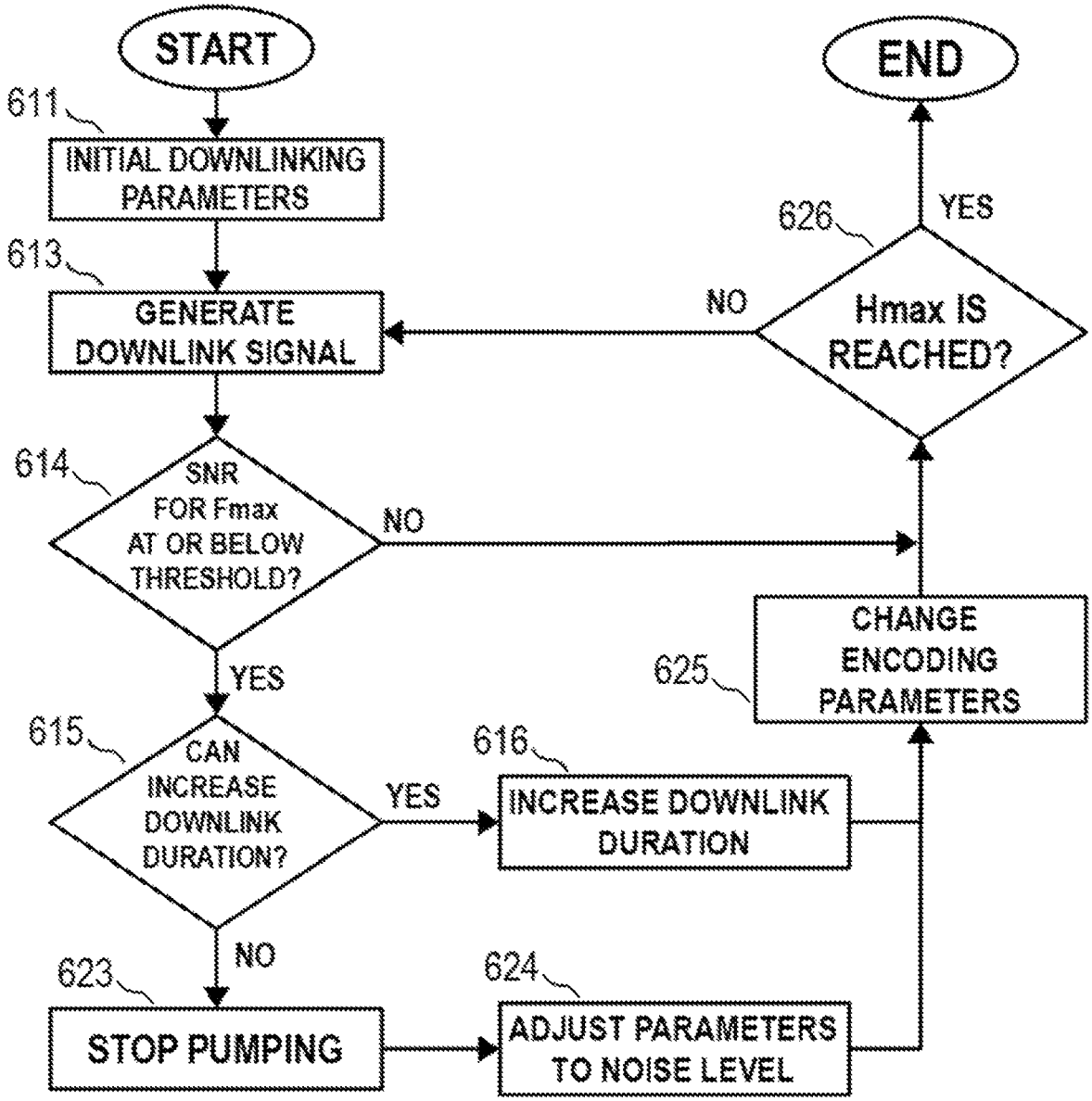
FIG. 25 is a flow chart of the options to increase signal to white noise ratio according to some embodiments of the present disclosure.

The present invention method includes options designed to increase the ratio of signal-to-noise. FIG. 25 demonstrates the logic and the sequence of steps required to satisfy the condition of reliable signal detection in the presence of random noises. The first step incorporates estimation and application of the initial parameters for downlinking performed at the beginning (611). The generator 51 at the surface waits for a downlinking command and generates a corresponding downlinking signal as soon as the command is ready (613). BHA receives downlinking signal (614), tries to decode a command and estimates decoding quality. If the signal could not be detected reliably, the emergency uplink procedure is performed to notify surface system about insufficient signal strength (see 591 in FIG. 23). If the system determines that the magnitude of the signal (block 614) is sufficient, none of following options is required, the system operates without changes and performs checks if maximum depth $H_{max}$ is reached (at each iteration) and drilling should be stopped. If the situation requires the increase of SNR the first option is making downlinking signal longer (615, 616). In the rare event when extremely high noise level is present and for a practical reasons it is not possible to further increase duration of the downlinking signal, another option to increase of SNR is used, which requires stopping of pumping (623). After that downlinking parameters should be adjusted to lower level of noise (624) by changing downlinking encoding/decoding scheme (625). A typical change will include using short duration T of downlinking signals.

Figure 26:
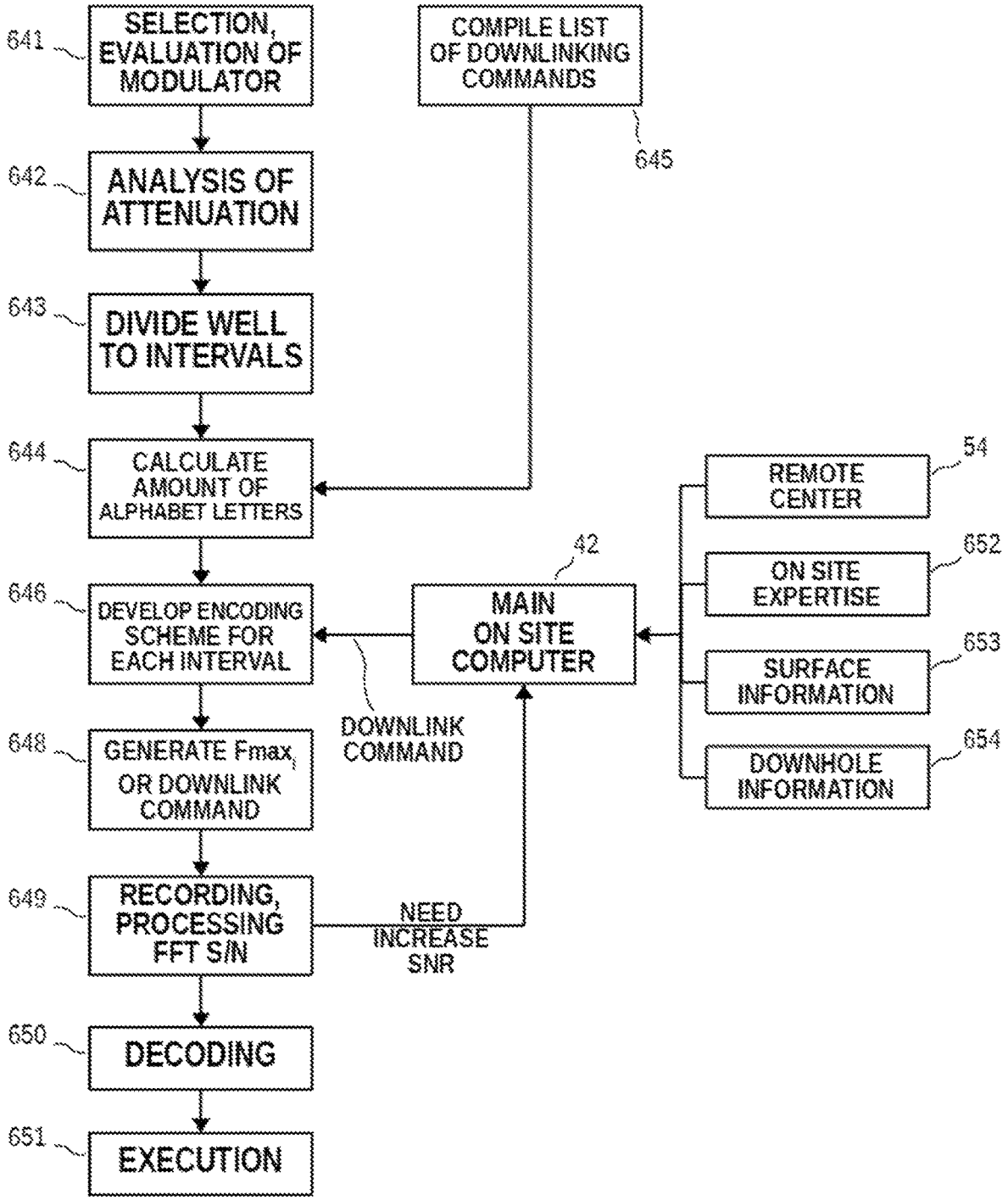
FIG. 26 is a flow chart of the combinatorial frequencies alphabet method according to some embodiments of the present disclosure.

FIG. 26 provides a more detailed overview of the method shown in FIG. 2 in order to visualize one illustration various steps of components of the combinatorial frequencies alphabet method and their relationships. Some components, such as main on site computer and software 42, a modulator 51 and remote center 54, were shown in other figures. All remaining components have new reference numbers to help better show their communication, flow and mutual dependency. For simplicity, not all steps and components of the method are shown in FIG. 26.

The method and apparatus of the present invention overcome the disadvantages of the prior art by providing the opportunity to generate pressure waves in the flow supply line by applying forces to the outside surface of the pipe without any restrictions of the mud flow (e.g., without any structures associated with the modulator being disposed inside of the pipe itself, and only positioned against the outer surface of the pipe). The modulator generates low amplitude harmonical pressure waves in the range of 0.1-10 psi and causes no interference with surface pumping equipment. A modulator 51 transmits commands and data to a downhole pressure transducer 13 disposed in BHA, as previously described with reference to FIG. 1.

Pressure transducer may have a sensitivity 0.01 psi or in some situation with deep wells even 0.001 psi. Analysis of pressure wave attenuation 642 in FIG. 26 is providing quantitative evaluation of frequencies attenuation in the range from 1-2 Hz up to $F_{max}$ of a modulator in the measured depth of drilling up to $H_{max}$ of the well. In order to have robust recording by pressure transducer 13, an amplitude of a pressure wave with a particular frequency may have amplitude 10-15 times higher than a sensitivity of the pressure transducer. For a deep well, the present invention uses division of a well trajectory for a few intervals (block 643) in FIG. 26 where for each interval the range of frequencies is selected. It is possible that for the deep portion of the well the range of orthogonal frequencies which have amplitude 10-15 times higher than pressure transducer 13 sensitivity consists of only low frequencies, resulting reducing amount of letters in the combinatorial frequencies alphabet. In such situations, a full list of downlinking command block 645 (including functionality and values) and amount of frequencies components (amount of letters in the combinatorial frequency alphabet) block 644 is used, and an encoding scheme is developed for each interval (block 646). For most wells and for a significant part of the trajectory of long wells, all predefined downlinking commands may be encoded by using just single letter words. In other cases, the encoding scheme includes combination of words with single and double letters. Moreover, for the most frequent downlinking commands, the use of words consisting of one letter is provided in order to have higher transmission rate. Planning stage of the disclosed invention method includes blocks 641, 642, 643, 644, 645 and 646.

The present invention method allows for broadening of the range of downlinking commands and uses more bits to represent the command values. The method includes at least three group of commands: service/supporting commands; commands for managing RSS parameters; and commands to optimize data acquisition densities/parameters including instruction on saving energy sources. The final step of preparation to the downlinking during LWD operation includes an initialization stage.

After the drilling operation starts, pumps is on, at the BHA level, pressure transducer initiated by "flow stat" sensor, starts recording, processing and performs FFT on sliding base resulting calculation of signal to white noise ratio. If the ratio falls down below the threshold, the uplink command is initiated requesting a need to increase said ratio.

Thus, prior to generate a downlinking command, the system has information on downlinking command duration T, sufficient for robust detection and decoding of a downlinking command. A process of generating an immediate downlinking command includes receiving data from downhole sensors, surface located devices (block 654, 653 in FIG. 26) and requests from on-site (block 652) and remotely located experts (block 54). Software from main on-site computer is configured to produce an immediate downlinking command based on processing of the above data and information. Such command is encoded and transmitted to a modulator 51 for execution.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A method for downlinking communication from a surface location to a bottom hole assembly during drilling operation, the method comprising:

(a) pumping drilling fluid through a fluid line and through a drill string to the bottom hole assembly;

(b) generating pressure wave signals by a modulator disposed against an outside surface of the fluid line at an outside-surface location of the fluid line, wherein the modulator is disposed entirely outside of the fluid line;

(c) detecting and receiving at the bottom hole assembly the pressure wave signals generated by the modulator; and (d) processing and decoding the pressure wave signals with a decoder associated with the bottom hole assembly to identify a downlinking command purpose represented by the pressure wave signals and a required action for controlling drilling operations;

(e) wherein at least one of:

i. the pressure wave signals generated by the modulator include at least one letter of a downlinking combinatorial frequencies alphabet, the at least one letter of the downlinking combinatorial frequencies alphabet includes one or more orthogonal frequencies, an alphabetic component of the downlinking combinatorial frequencies alphabet with a highest frequency $F_{max}$ is determined by the modulator, and a selection of the modulator is based on a required value of the highest frequency $F_{max}$; or ii. the pressure wave signals generated by the modulator include at least one letter of a downlinking combinatorial frequencies alphabet, the at least one letter of the downlinking combinatorial frequencies alphabet includes one or more orthogonal frequencies; the alphabetic component of the downlinking combinatorial frequencies alphabet with a minimum frequency is determined by the modulator, and an initial amplitude of pressure wave signals at a frequency $F_{min}$ is equal to or greater than 10-15 times of a transducer sensitivity for a maximum hole measured depth; or iii. the modulator generates the pressure wave signals by applying forces around an entire circumference of the outside surface of the fluid line, the pressure wave signals generated by the modulator are periodic wave pressure signals, the modulator tightly compresses the outside surface of the fluid line and performs periodic force actions in a direction perpendicular to the fluid line, and the modulator includes two jackets tightly compressed against the outside surface of the fluid line due to mutual tightening with fixing bolts, each jacket including a compartment filled with oil; or iv. the modulator generates the pressure wave signals by applying forces around an entire circumference of the outside surface of the fluid line, the pressure wave signals generated by the modulator are periodic wave pressure signals, a choice of a command type and value of a downlinking command is based on a combined evaluation of real-time data from bottom hole assembly sensors, surface gages, drilling parameters, information from an onsite operator, and instruction from a remote center, and the method comprises encoding the downlinking command and transmitting corresponding one or more alphabet letters to a controller of the modulator to generate a harmonic pressure wave signal; or v. the modulator generates the pressure wave signals by applying forces around an entire circumference of the outside surface of the fluid line, the pressure wave signals generated by the modulator are periodic wave pressure signals, the pressure wave signals represent different command types in the form of service commands, RSS commands for managing rotary steering system parameters, and optimization commands for optimization of at least one of acquisition and saving energy resources, and if multiple command types are transmitted simultaneously, the method comprises setting the service commands as highest priority, setting the RSS commands as a second highest priority, and setting the optimization commands as lowest priority for performing the required action associated with each of the command types; or vi. the modulator generates the pressure wave signals by applying forces around an entire circumference of the outside surface of the fluid line, the pressure wave signals generated by the modulator are periodic wave pressure signals, and the method comprises detecting a presence of flow of the drilling fluid by a sensor disposed in the bottom hole assembly, wherein the sensor is a flow stat device, and comprising initiating recording of the pressure wave signals by a pressure transducer after detection of the presence of flow of the drilling fluid by the sensor.

2. The method of claim 1, wherein the modulator generates the pressure wave signals by applying forces around a partial circumference of the outside surface of the fluid line.

3. The method of claim 2, wherein the modulator is disposed against the partial circumference of the outside surface of the fluid line.

4. The method of claim 1, wherein if (e)(iii), (e)(iv), (e)(v) or (e)(vi), the method comprises operating one or more additional modulators to generate additional pressure wave signals along a central longitudinal axis of the fluid line to increase an amplitude of the pressure wave signals.

5. The method of claim 1, wherein if (e)(ii), an amount of orthogonal frequencies K in the downlinking combinatorial frequencies alphabet is determined based on a range of frequencies from a minimum frequency $F_{min}$ to a maximum frequency $F_{max}$, and on a selected equivalent duration (T) of output of a single alphabet member of the downlinking combinatorial frequencies alphabet by:

$K=((F_{max}-F_{min})/\Delta f)+1$, where $\Delta f=1/T$ represents a difference in Hz of adjacent orthogonal frequencies, where T represents the selected equivalent duration, and $T=1,024*2^n$ ms, where n=0, 1, 2. . . .

6. The method of claim 5, comprising adjusting the range of frequencies for attenuation during propagation of the pressure wave signals from the modulator to the bottom hole assembly.

7. The method of claim 6, wherein an effect of the attenuation is represented by:

$$P = P_0 \exp\left[-4\pi f\left(\frac{D}{d}\right)^2\left(\frac{\mu}{K}\right)\right]$$

where P is a signal strength at a surface transducer; $P_0$ is a signal strength at the modulator; f is a carrier frequency of a measurement-while-logging signal; D is a measured depth between a downhole transducer and the modulator; d is an inside diameter of the fluid line; u is a plastic viscosity of the drilling fluid; and K is a bulk modulus of a volume of drilling fluid above the downhole transducer.

8. The method of claim 7, wherein based on an effect of the attenuation on higher frequencies alphabet members, a length of a drilling well is divided by two of more intervals and each interval has a different value of maximum frequency $Fmax_i$, where i is a number of intervals.

9. The method of claim 7, wherein:

a division for the intervals is based on predetermined criteria for a minimum amplitude value for each frequency in order to allow robust recording of the generated pressure wave signals for a pressure transducer; and robust recording necessitates that the amplitude of each frequency at the bottom hole assembly depth is 10-15 times greater than a sensitivity of the pressure transducer.

10. The method of claim 9, comprising using a maximum frequency $F_{maxi}$ to analyze a signal-to-white noise level ratio, wherein:

a criteria for a robust detection of alphabetic harmonic components of the downlinking signals is established when an amplitude of spectrum of a signal harmonics is higher than three standard deviations of amplitude of white noise ($A_{signal}>3*\sigma_{noise}$);

an increase of the signal-to-white noise level ratio is achieved by downlinking duration of the at least one letter each time when uplink communication indicates that an amplitude of spectrum for the maximum frequency $F_{maxi}$ is not sufficient;

if an amplitude spectrum for the maximum frequency $F_{maxi}$ is not sufficient, an increase of the signal-to-noise ratio is achieved by increasing the duration of the downlinking command;

if the duration of the downlinking signal reaches a predefined limit, and an energy of white noise is 200 times or more than an energy of signal harmonics, the method comprises lifting a drill bit from the bottom hole assembly; and if all options are exhausted, the method comprises to stop pumping.

11. The method of claim 1, wherein if (e)(vi), a sampling frequency of the sensor is not less than $2*F_{maxi}$, where $F_{maxi}$ is a maximum frequency for an i interval.

12. The method of claim 1, wherein if (e)(vi), the method comprises removing a constant zero frequency component, applying band-pass filtering and performing band selectable Fourier analysis on a sliding base equal to a used duration of the at least one letter of the downlinking combinatorial frequencies alphabet to process the pressure wave signals recorded by the pressure transducer, wherein:

a processor of the pressure transducer recognizes harmonics, which includes decoding of a downhole signal to determine a command purpose and associated command value; and decoding is based on pattern recognition of a behavior of harmonic components of the pressure wave signals along a timeline after applying Fourier analysis on the sliding base.

13. A system for downlinking communication from a surface location to a bottom hole assembly during drilling operation, the system comprising:

(a) a surface-located fluid line;

(b) a pump configured to pump drilling fluid through the surface-located fluid line and through a drill string to the bottom hole assembly;

(c) a modulator disposed against an outside surface of the surface-located fluid line and capable of generating pressure wave signals in the drilling fluid by applying a harmonical force to the outside surface of the surface-located fluid line in a direction perpendicular to a central longitudinal axis of the surface-located fluid line;

(d) a mud pulse telemetry system associated with the bottom hole assembly including at least one sensor for measuring formation properties;

(e) a downhole pressure sensor configured to detect encoded pressure fluctuations generated by the modulator in the drilling fluid;

(f) a controller configured to process and decode downlinking commands associated with the encoded pressure fluctuations, wherein the controller is in communication with the bottom hole assembly and is configured to execute the decoded downlinking commands to control drilling operations;

wherein at least one of:

i. the modulator includes two jackets fit tightly against the outside surface of the surface-located fluid line and the two jackets are tightened to each other with fixing bolts; or ii. the bottom hole assembly includes at least one sensor capable of identifying a presence of drilling fluid flow due to pumping of the drilling fluid by a pump through the surface-located fluid line, and detection of starting of pumping and stopping of pumping of the drilling fluid through the surface-located fluid line triggers a start and end, respectively, of recording of pressure fluctuations by a pressure sensor; or iii. the modulator generates the encoded pressure fluctuations with a harmonic signal with a frequency equal to a maximum frequency $F_{maxi}$ before and after downlinking commands, and a pressure transducer sensor in the bottom hole assembly is configured to calculate a signal-to-white noise level ratio.

14. The system of claim 13, wherein if (i), an inner surface of the jackets is a thin steel plate which, with increasing oil pressure in the jackets, fits snugly against the outside surface of the surface-located fluid line.

15. The system of claim 14, wherein if (i), an outer part of the jackets is a thick steel plate capable of withstanding with a standard margin a maximum oil pressure achieved during operation of modulator.

16. The system of claim 13, wherein if (i), each jacket is mechanically and hydraulically connected to a stepped hydraulic cylinder with a hydraulic piston which generates harmonic pressure in oil inside of the jackets.

17. The system of claim 16, wherein a stepped hydraulic cylinder is connected by a pressure hose to a hydraulic cylinder of lower pressure with a piston performing reciprocating movements due to a cam mechanism.

18. The system of claim 17, wherein the cam mechanism includes flywheel of a profile that ensures movement of the piston in a lower pressure chamber according to a harmonic law.

19. The system of claim 18, wherein the cam mechanism is driven by an electric motor which is disposed outside of the surface-located fluid line, the electrical motor including a power unit in a form of a battery or power source; and wherein driving of the modulator with the electrical motor is regulated by a motor controller.

20. The system of claim 19, wherein:

a main onsite computer transmits through a data exchange device a sequence of letters of a downlinking combinatorial frequencies alphabet which represents an encoded downlinking command; and the modulator generates a pressure wave fluctuation in accordance with the sequence of letters of the downlinking combinatorial frequencies alphabet.

21. The system of claim 13, wherein if (ii):

the pressure sensor includes a processor, software, circuit boards, and a pressure measuring device;

a sensitivity of the pressure measuring device is 0.01 psi or 0.001 psi;

the pressure sensor is configured to record, filter, process pressure wave fluctuation, and perform amplitude spectrum analysis using a Fast Fourier Transform; and a controller, processor and software are configured to decode the downlinking command by using pattern recognition of signal frequencies based on Fast Fourier Transform results from calculation on a sliding base.

22. The system of claim 21, wherein:

an initial signal duration of a single combinatorial alphabet letter T is doubled each time when an uplink request is generated until a new calculated time is less than a predefined $T_{maxl}$, where $T_{maxl}$ is a maximum duration of time allowed for transmission of one letter.

23. The system of claim 22, wherein when all options are exhausted and an energy of white noise is 200 times or more than an energy of signal harmonics, a drill bit is lifted from the bottom hole assembly and the single combinatorial alphabet letter T is adjusted by varying T.

24. The system of claim 23, wherein a decoded downlinking command type and value is transmitted via internal wires to the main controller of the bottom hole assembly for an execution.

25. The system of claim 24, wherein a surface sensor real-time information, downhole real-time data, remote center guidance, and onsite operations are processed on the main onsite computer to produce appropriate downlinking instructions to apply the encoded combinatorial alphabet signal schemes at the bottom hole assembly.

26. The system of claim 13, wherein if (iii), the pressure transducer sensor is configured to request through an uplink communication an increase of the signal-to-white noise level ratio if the calculated signal-to-white noise level ratio drops below a predefined threshold level.

* * * * *